US012669123B2

(12) United States Patent
Liu et al.

(10) Patent No.: US 12,669,123 B2
(45) Date of Patent: Jun. 30, 2026

(54) FIXED SCROLL ASSEMBLY, SCROLL COMPRESSOR, AND METHOD FOR MACHINING FIXED SCROLL ASSEMBLY

(71) Applicant: Copeland Climate Technologies (Suzhou) Co., Ltd., Suzhou (CN)

(72) Inventors: Xuan Liu, Suzhou (CN); Yuancan Fang, Suzhou (CN); Pei Jin, Suzhou (CN); Lili Li, Suzhou (CN); Bendong He, Suzhou (CN); Yun Chen, Suzhou (CN)

(73) Assignee: Copeland Climate Technologies (Suzhou) Co., Ltd., Jiangsu (CN)

( * ) Notice: Subject to any disclaimer, the term of this patent is extended or adjusted under 35 U.S.C. 154(b) by 0 days.

(21) Appl. No.: 18/879,333

(22) PCT Filed: Jun. 30, 2023

(86) PCT No.: PCT/CN2023/104610
§ 371 (c)(1),
(2) Date: Dec. 27, 2024

(87) PCT Pub. No.: WO2024/002338
PCT Pub. Date: Jan. 4, 2024

(65) Prior Publication Data

US 2025/0172141 A1 May 29, 2025

(30) Foreign Application Priority Data

Jun. 30, 2022 (CN) ..... 202210757840.7
Jun. 30, 2022 (CN) ..... 202210760032.6
(Continued)

(51) Int. Cl.
*F04C 18/02* (2006.01)
*F04C 29/12* (2006.01)

(52) U.S. Cl.
CPC ..... *F04C 18/0215* (2013.01); *F04C 29/12* (2013.01); *F04C 2230/10* (2013.01)

(58) Field of Classification Search
CPC ..... F04C 18/0215; F04C 18/0261; F04C 27/005; F04C 28/24; F04C 29/12;
(Continued)

(56) References Cited

U.S. PATENT DOCUMENTS 8,764,423 B2 * 7/2014 Ignatiev ..... F04C 18/0253 417/310
10,400,772 B2 * 9/2019 Sun ..... F04C 29/128
(Continued)

FOREIGN PATENT DOCUMENTS

CN 102449313 A 5/2012
CN 102449314 A 5/2012
(Continued)

OTHER PUBLICATIONS

International Search Report of the ISA issued in PCT/CN2023/104610, mailed Sep. 15, 2023, ISA/CN.
(Continued)

*Primary Examiner* — Dapinder Singh
(74) *Attorney, Agent, or Firm* — Harness, Dickey & Pierce, P.L.C.

(57) ABSTRACT

A fixed scroll assembly, a scroll compressor, and a method for machining a fixed scroll assembly includes a fixed scroll component and a sealing assembly. The fixed scroll component includes an end plate, a fixed scroll roll extending from a first side of the end plate, and an enhanced vapor injection hole extending from an upper surface of the fixed scroll component to a compression cavity. The enhanced vapor injection hole has a first end leading to the compression cavity, and a second end leading to the exterior of the fixed scroll assembly. The sealing assembly is configured to
(Continued)

seal the second end of the enhanced vapor injection hole; and part of the enhanced vapor injection hole comprises a recess formed in the fixed scroll roll.

18 Claims, 23 Drawing Sheets

(30) Foreign Application Priority Data

Jun. 30, 2022 (CN) ..... 202221667261.5
Jun. 30, 2022 (CN) ..... 202221670020.6

(58) Field of Classification Search
CPC ..... F04C 29/0007; F04C 2230/10; F04C 2240/10; F04C 2250/30
See application file for complete search history.

(56) References Cited

U.S. PATENT DOCUMENTS

| | | | | |
|---|---|---|---|---|
| 11,384,759 | B2 * | 7/2022 | Bhatia | F04C 29/042 |
| 2009/0297378 | A1 | 12/2009 | Stover et al. | |
| 2010/0300659 | A1 * | 12/2010 | Stover | F04C 18/0215 165/104.31 |
| 2010/0303659 | A1 | 12/2010 | Stover et al. | |
| 2014/0037486 | A1 * | 2/2014 | Stover | F04C 28/26 418/55.1 |
| 2015/0192121 | A1 | 7/2015 | Sung et al. | |
| 2017/0306960 | A1 | 10/2017 | Pax et al. | |
| 2021/0285445 | A1 * | 9/2021 | Bhatia | F04C 18/0215 |
| 2022/0299026 | A1 * | 9/2022 | Ding | F04C 2/025 |
| 2022/0325715 | A1 * | 10/2022 | Lepak | F04C 29/0021 |
| 2023/0042489 | A1 * | 2/2023 | Lee | F04C 18/0215 |

FOREIGN PATENT DOCUMENTS

| | | | |
|---|---|---|---|
| CN | 202971187 | U | 6/2013 |
| CN | 203201801 | U | 9/2013 |
| CN | 104196725 | A | 12/2014 |
| CN | 106286292 | A | 1/2017 |
| CN | 207377799 | U | 5/2018 |
| CN | 108626117 | A | 10/2018 |
| CN | 110513289 | A | 11/2019 |
| CN | 111502987 | A | 8/2020 |
| CN | 113623205 | A | 11/2021 |
| CN | 114087176 | A | 2/2022 |
| CN | 217873271 | U | 11/2022 |
| CN | 218093424 | U | 12/2022 |
| JP | H02211395 | A | 8/1990 |
| JP | H0626476 | A | 2/1994 |
| KR | 20100081814 | A | 7/2010 |

OTHER PUBLICATIONS

Chinese First Office Action regarding Application No. 202210757840.7, dated Mar. 21, 2026, with English translation.
Chinese First Office Action regarding Application No. 202210760032.6, dated Apr. 15, 2026, with English translation.

* cited by examiner

FIXED SCROLL ASSEMBLY, SCROLL COMPRESSOR, AND METHOD FOR MACHINING FIXED SCROLL ASSEMBLY

CROSS-REFERENCE TO RELATED APPLICATIONS

This application is the national phase of International Application No. PCT/CN2023/104610 titled "FIXED SCROLL ASSEMBLY, SCROLL COMPRESSOR, AND METHOD FOR MACHINING FIXED SCROLL ASSEMBLY" and filed on Jun. 30, 2023, which claims priorities to the Chinese patent application No. 202210757840.7, titled "FIXED SCROLL ASSEMBLY, SCROLL COMPRESSOR, AND METHOD FOR MACHINING FIXED SCROLL ASSEMBLY", filed on Jun. 30, 2022 with the China National Intellectual Property Administration; Chinese patent application No. 202221670020.6, titled "FIXED SCROLL ASSEMBLY AND SCROLL COMPRESSOR", filed on Jun. 30, 2022 with the China National Intellectual Property Administration; Chinese patent application No. 202210760032.6, titled "FIXED SCROLL ASSEMBLY, SCROLL COMPRESSOR, AND METHOD FOR MACHINING FIXED SCROLL ASSEMBLY", filed on Jun. 30, 2022 with the China National Intellectual Property Administration; and Chinese patent application No. 202221667261.5, titled "FIXED SCROLL ASSEMBLY AND SCROLL COMPRESSOR", filed on Jun. 30, 2022 with the China National Intellectual Property Administration, which are incorporated herein by reference in their entireties.

FIELD

The present application relates to the field of compressors, and in particular to a fixed scroll assembly, a scroll compressor including the same, and a method for machining a fixed scroll assembly.

BACKGROUND

The contents of this section provide only background information relevant to the present application, which may not constitute the prior art.

In a scroll compressor, especially in a large-horsepower scroll compressor, a refrigerant can be replenished to a specified position in a compression chamber through an enhanced vapor injection jet orifice that is in fluid communication with the compression chamber of the scroll compressor, so as to achieve an enthalpy enhancing effect and to improve the performance of the compressor. In a conventional scroll compressor, the enhanced vapor injection jet orifice is usually machined on one side, on which a fixed scroll is provided, of an end plate of a fixed scroll component. In this case, the orifice is required to avoid the profile of the fixed scroll when being drilled, and the enhanced vapor injection jet orifice is not allowed to exceed the width of the profile of an orbiting scroll of an orbiting scroll component, so as to prevent leakage of fluid in a corresponding compression chamber to another adjacent compression chamber. Accordingly, the process of machining the enhanced vapor injection jet orifice in the conventional technology is required to be improved, and the size and flow area of the enhanced vapor injection jet orifice are limited.

On the other hand, in some scroll compressors, a bypass orifice is usually provided at a medium-pressure compression chamber, to selectively enable the medium-pressure compression chamber to be in fluid communication with a low-pressure side or disconnect the medium-pressure compression chamber from a low-pressure side, so as to change the displacement of the scroll compressor without changing the rotating speed of the scroll compressor. Conventional large-horsepower scroll compressors do not usually include both a variable displacement structure and an enhanced vapor injection structure. If the variable displacement structure and the enhanced vapor injection structure are simply integrated into a large-horsepower scroll compressor, the number of parts, the difficulty of machining, and the volume increase, which results in time-consuming assembly, increased overall volume, and increased costs.

SUMMARY

One object of the present application is to simplify the structure and machining of a scroll compressor.

Another object of the present application is to increase the flow area of an enhanced vapor injection jet orifice in a scroll compressor.

Yet another object of the present application is to integrate a variable displacement structure and an enhanced vapor injection structure in a scroll compressor, thereby further simplifying the structure and machining of the scroll compressor.

Still yet another object of the present application is to seal a variable displacement bypass orifice and an enhanced vapor injection jet orifice in the scroll compressor with a common sealing structure, thereby reducing the number of sealing components required.

A fixed scroll assembly is provided according to an aspect of the present application. The fixed scroll assembly includes a fixed scroll component and a sealing assembly. The fixed scroll component includes an end plate and a fixed scroll extending from a first side of the end plate. The fixed scroll component is provided with an enhanced vapor injection jet orifice extending from an upper surface of the fixed scroll component to a compression chamber. An enhanced vapor injection fluid external to a compressor including the fixed scroll assembly is capable of being supplied into the compression chamber via the enhanced vapor injection jet orifice, and the enhanced vapor injection jet orifice has a first end leading to the compression chamber and a second end leading to an exterior of the fixed scroll assembly. The sealing assembly is configured to seal the second end of the enhanced vapor injection jet orifice.

In an embodiment, the enhanced vapor injection jet orifice may include a first part and a second part. The first part extends to the first side of the end plate and is not overlapped with the fixed scroll when viewed in an axial direction of the fixed scroll assembly. The second part extends through the end plate into the fixed scroll and is overlapped with the fixed scroll when viewed in the axial direction of the fixed scroll assembly. The second part includes a recess formed in the fixed scroll.

In an embodiment, the enhanced vapor injection jet orifice may extend through the end plate from a second side, opposite to the first side, of the end plate.

In an embodiment, the fixed scroll component may include a hub portion protruding in an axial direction of the fixed scroll assembly from a second side, opposite to the first side, of the end plate, and the enhanced vapor injection jet orifice extends through the hub portion and the end plate from an upper surface of the hub portion.

In an embodiment, the fixed scroll component may further include an enhanced vapor injection inlet orifice and an enhanced vapor injection passage connecting the enhanced vapor injection inlet orifice with the enhanced vapor injection jet orifice, where the enhanced vapor injection jet orifice has a hydraulic diameter less than or equal to the hydraulic diameter of the enhanced vapor injection passage.

In an embodiment, in a thickness direction of the fixed scroll, the depth of the recess does not exceed two thirds of the thickness of the fixed scroll.

In an embodiment, the height of the recess along the axial direction of the fixed scroll component is greater than or equal to a hydraulic radius of the enhanced vapor injection jet orifice.

In an embodiment, the sealing assembly may include a press plate and a sealing gasket.

In an embodiment, the sealing assembly may further include a fastener configured to fasten and tightly press the sealing gasket and the press plate to the upper surface of the fixed scroll component.

In an embodiment, the fixed scroll component may further include a bypass orifice extending from the upper surface of the fixed scroll component to the compression chamber, and the fluid in the compression chamber is dischargeable through the bypass orifice into a low-pressure region external to the fixed scroll component. The sealing assembly is configured to seal both the bypass orifice and the enhanced vapor injection jet orifice.

In an embodiment, the fixed scroll component may include two or more groups of orifices spaced apart in a circumferential direction, where each group of orifices in the two or more groups of orifices includes at least one bypass orifice and at least one enhanced vapor injection jet orifice.

In an embodiment, the fixed scroll component may include two or more groups of orifices spaced apart in a circumferential direction, where each group of orifices in the two or more groups of orifices includes at least one bypass orifice and at least one enhanced vapor injection jet orifice.

In an embodiment, the sealing assembly may include a piston, which is provided in the bypass orifice and is movable between a first position where a corresponding compression chamber is permitted to be in fluid communication with the low-pressure region and a second position where the corresponding compression chamber is prevented from being in fluid communication with the low-pressure region.

In an embodiment, the fixed scroll assembly may further include a fluid control device. The fluid control device is configured to control a pressure difference between positions above and below the piston by introducing a fluid having a predetermined pressure to the position above the piston, to control movement of the piston.

In an embodiment, a communication groove which allows all of the bypass orifices or the bypass orifices in each group of orifices to be in communication with each other and to be communicable with a high-pressure region may be provided on the upper surface of the fixed scroll component. The fluid in the high-pressure region has a pressure greater than the pressure of the fluid in the compression chamber in communication with the bypass orifice, and the communication groove is sealed at the upper surface of the fixed scroll component by the sealing assembly.

In an embodiment, the fixed scroll component may further include an exhaust slot. The exhaust slot is configured to allow all of the bypass orifices or the bypass orifices in each group of orifices to be in communication with each other and in fluid communication with the low-pressure region via the exhaust slot.

A scroll compressor including the fixed scroll assembly according to the above aspect is provided according to another aspect of the present application.

A method for machining the fixed scroll assembly according to the above aspect is provided according to yet another aspect of the present application. The method includes: machining, in a fixed scroll component, at least one enhanced vapor injection jet orifice extending from an upper surface of the fixed scroll component to a compression chamber, where an enhanced vapor injection fluid external to a compressor including the fixed scroll assembly is capable of being supplied into the compression chamber via the enhanced vapor injection jet orifice, and the enhanced vapor injection jet orifice has a first end leading to the compression chamber and a second end leading to an exterior of the fixed scroll assembly; and manufacturing a sealing assembly, configured to seal the second end of the enhanced vapor injection jet orifice.

A fixed scroll assembly is provided according to another aspect of the present application. The fixed scroll assembly includes a fixed scroll component and a sealing assembly. The fixed scroll component is provided with an end plate and a fixed scroll extending from a first side of the end plate. The fixed scroll component is provided with at least one group of orifices. Each group of orifices in the at least one group of orifices includes a bypass orifice and the enhanced vapor injection jet orifice. A fluid in the compression chamber is dischargeable through the bypass orifice into a low-pressure region external to the fixed scroll component. An enhanced vapor injection fluid external to the compressor including the fixed scroll assembly is capable of being supplied into the compression chamber via the enhanced vapor injection jet orifice. The sealing assembly is configured to seal grouped orifices in the at least one group of orifices.

In an embodiment, the fixed scroll component may include two or more groups of orifices spaced apart in a circumferential direction.

In an embodiment, the sealing assembly may include a piston, which is provided in the bypass orifice and is movable between a first position where a corresponding compression chamber is permitted to be in fluid communication with the low-pressure region and a second position where the corresponding compression chamber is prevented from being in fluid communication with the low-pressure region.

In an embodiment, the fixed scroll assembly may further include a fluid control device. The fluid control device is configured to control a pressure difference between positions above and below the piston by introducing a fluid having a predetermined pressure to the position above the piston, to control movement of the piston.

In an embodiment, the fixed scroll component may further include a fluid passage communicating the bypass orifice with a high-pressure region, where the fluid in the high-pressure region has a pressure greater than the pressure of the fluid in the compression chamber in communication with the bypass orifice. The fluid control device may include a valve, which is configured to selectively enable the fluid passage to be in communication or to disconnect the fluid passage, to change the pressure difference between the positions above and below the piston.

In an embodiment, a communication groove, which allows all of the bypass orifices or the bypass orifices in each group of orifices to be in communication with each other and in fluid communication with at least one of the fluid passage, may be provided on the upper surface of the fixed scroll component. The communication groove may be sealed by the sealing assembly.

In an embodiment, the fluid passage may include a first fluid passage and a second fluid passage. The first fluid passage extends from an outer peripheral surface of the fixed scroll component to the high-pressure region, and the second fluid passage extends from the outer peripheral surface of the fixed scroll component to the communication groove. The valve is arranged between the first fluid passage and the second fluid passage.

In an embodiment, the bypass orifice and the enhanced vapor injection jet orifice may extend from the upper surface of the end plate to a corresponding compression chamber.

In an embodiment, the fluid control device may be provided on the outer periphery surface of the end plate.

In an embodiment, a recess may be formed on the upper surface of the end plate. A side wall of the recess is provided with an exhaust slot. The exhaust slot is configured to allow all of the bypass orifices or the bypass orifices in each group of orifices to be in communication with each other and with the low-pressure region via the exhaust slot.

In an embodiment, the fixed scroll component may include a hub portion protruding in an axial direction from the upper surface of the end plate, and the bypass orifice and the enhanced vapor injection jet orifice may extend from an upper surface of the hub portion into a corresponding compression chamber.

In an embodiment, the fluid control device may be provided on an outer periphery surface of the hub portion.

In an embodiment, an exhaust slot may be provided on an outer periphery surface of the hub portion. The exhaust slot is configured to allow all of the bypass orifices or the bypass orifices in each group of orifices to be in communication with each other and with the low-pressure region via the exhaust slot.

In an embodiment, the fixed scroll component may further include an enhanced vapor injection inlet orifice and an enhanced vapor injection passage. The enhanced vapor injection inlet orifice is located at the outer periphery surface of the end plate, and the enhanced vapor injection passage extends inside the end plate and is configured to allow the enhanced vapor injection inlet orifice to be in communication with the enhanced vapor injection jet orifice.

In an embodiment, the enhanced vapor injection jet orifice may include a recess formed in the fixed scroll.

In an embodiment, the sealing assembly may include a sealing gasket and a press plate, which are configured to cover and seal the bypass orifice and the enhanced vapor injection jet orifice.

In an embodiment, the sealing assembly may further include a fastener configured to fasten the sealing gasket and the press plate to the fixed scroll component.

A scroll compressor including the fixed scroll assembly according to the above aspect is provided according to another aspect of the present application.

A method for machining a fixed scroll assembly is provided according to yet another aspect of the present application. The fixed scroll assembly may include a fixed scroll component including a fixed scroll and an end plate. The method includes: machining, in the fixed scroll component, at least one group of orifices; and manufacturing a sealing assembly configured to seal grouped orifices in the at least one group of orifices. Each group of orifices in the at least one group of orifices includes a bypass orifice and an enhanced vapor injection jet orifice. A fluid in the compression chamber is dischargeable through the bypass orifice into a low-pressure region external to the fixed scroll component. An enhanced vapor injection fluid external to a compressor including the fixed scroll assembly is capable of being supplied into the compression chamber via the enhanced vapor injection jet orifice.

In an embodiment, machining the at least one group of orifices may include machining the bypass orifice and the enhanced vapor injection jet orifice from an upper surface of the end plate towards a corresponding compression chamber.

In an embodiment, the method may further include: machining, on the upper surface of the fixed scroll component, a communication groove, which allows each group of bypass orifices or all of the bypass orifices to be in communication with each other and to be communicable with a high-pressure region. The fluid in the high-pressure region has a pressure greater than the pressure of the fluid in the compression chamber in communication with the bypass orifice.

In an embodiment, the method may further include: forming a recess on the upper surface of the end plate, and forming, on a side wall of the recess, an exhaust slot, configured to allow each group of the bypass orifices to be in communication with each other and in communication with the low-pressure region.

In an embodiment, the fixed scroll component includes a hub portion protruding in the axial direction from the upper surface of the end plate, and machining the at least group of orifices includes: machining the bypass orifice and the enhanced vapor injection jet orifice from an upper surface of the hub portion towards a corresponding compression chamber.

In an embodiment, the method may further include: machining, on the upper surface of the hub portion, a communication groove, which allows each group of bypass orifices or all of the bypass orifices to be in communication with each other and to be communicable with a high-pressure region. The fluid in the high-pressure region has a pressure greater than the pressure of the fluid in the compression chamber in communication with the bypass orifice.

In an embodiment, the method may further include: machining, on an outer periphery surface of the hub portion, an exhaust slot, configured to allow each group of bypass orifices or all of the bypass orifices to be in communication with each other and in communication with the low-pressure region.

Other fields of application of the present application will become more apparent from the following detailed description. It should be understood that the detailed descriptions and specific examples, although illustrating preferred embodiments of the present application, are intended for purpose of exemplary illustration, and are not intended to limit the present application.

BRIEF DESCRIPTION OF THE DRAWINGS

Embodiments of the present application will be described below only by way of example with reference to the accompanying drawings. In the accompanying drawings, the same features or components are represented by the same reference numerals. The accompanying drawings are not necessarily drawn to scale. For example, some parts may be exaggerated for clarity. In the accompanying drawings.

DETAILED DESCRIPTION OF THE EMBODIMENTS

Exemplary embodiments will be described more fully below with reference to the accompanying drawings.

The exemplary embodiments are provided so that the present application will be exhaustive and will more fully convey the scope to those skilled in the art. Many specific details such as examples of specific components, devices, and methods are set forth to provide a thorough understanding of the embodiments of the present application. It will be clear to those skilled in the art that the exemplary embodiments may be implemented in many different forms without using specific details, none of which should be construed as limiting the scope of the present application. In some exemplary embodiments, well-known processes, well-known device structures, and well-known technologies are not described in detail.

In the following description, the orientation terms related to "upper" and "lower", used herein are described according to the upper and the lower positions of the views shown in the accompanying drawings. In practical applications, the positional relationships of "upper" and "lower" used herein may be defined according to practical conditions. These relationships may be reversed.

A scroll compressor according to an embodiment of the present application is firstly described with reference to FIGS. 1 to 8. The scroll compressor may include a housing, a compression mechanism 1 accommodated in the housing, a drive mechanism for driving the compression mechanism 1, and the like. For the sake of simplicity, only the compression mechanism 1 and a corresponding sealing assembly of the scroll compressor are shown herein, and no other well-known structures of the scroll compressor are shown.

Figure 1:
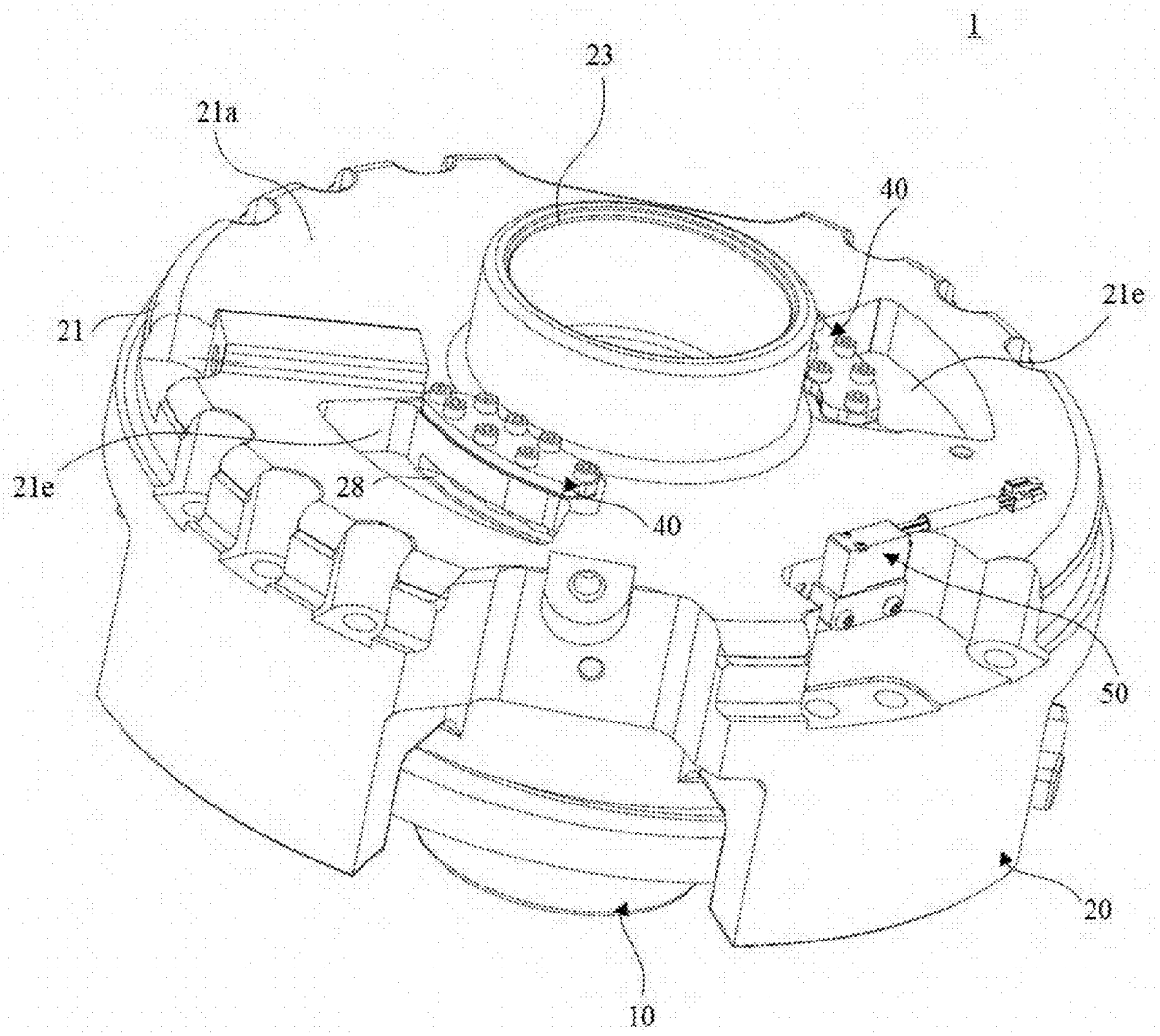
FIG. 1 illustrates a three-dimensional view of a compression mechanism of a scroll compressor according to an embodiment of the present application.
Figure 2:
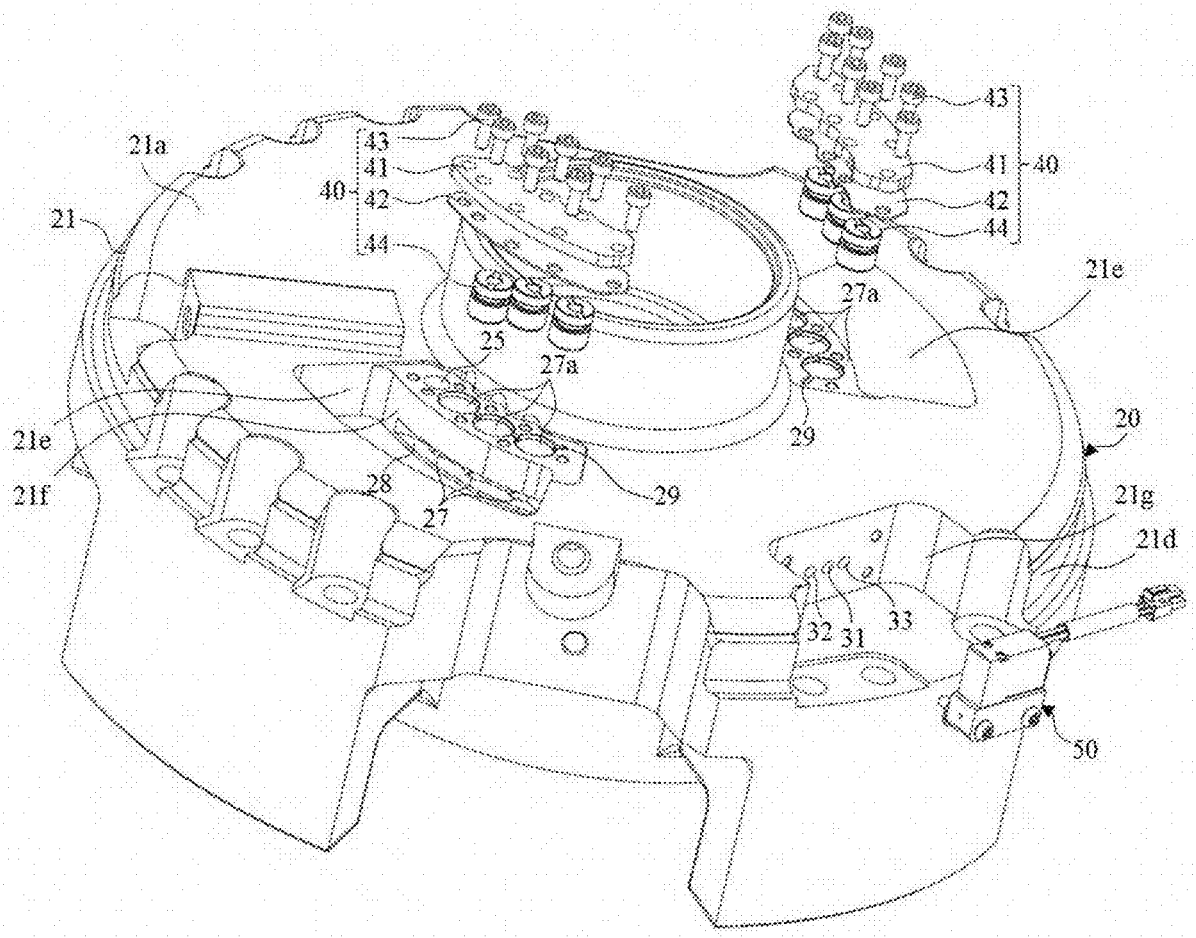
FIG. 2 illustrates an exploded view of a fixed scroll assembly in FIG. 1.
Figure 3:
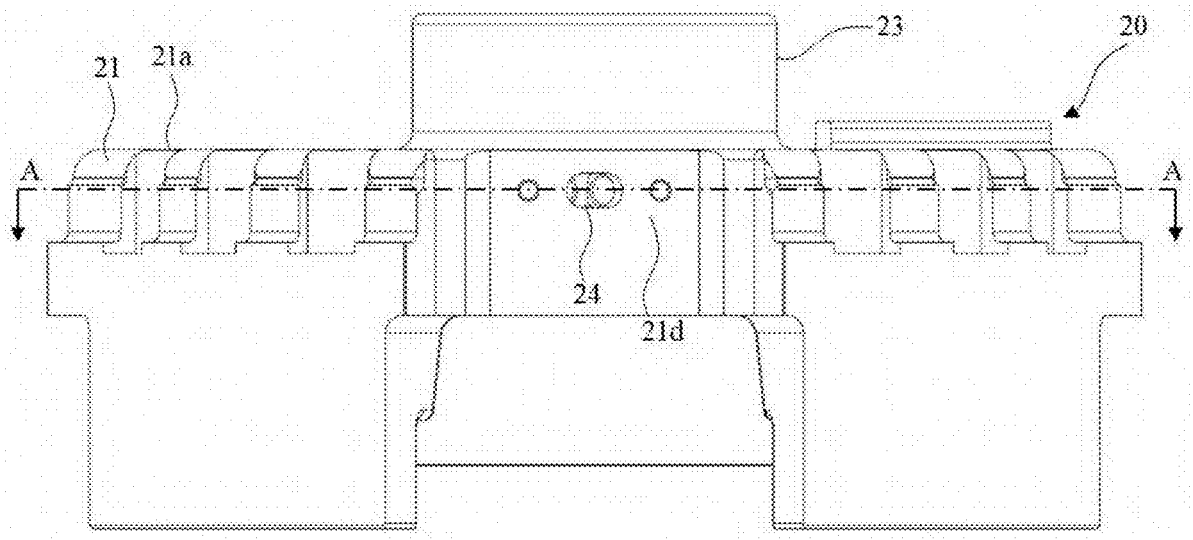
FIGS. 3 to 5 illustrate a side view, a top view, and a bottom view of a fixed scroll component in FIG. 1, respectively.
Figure 4:
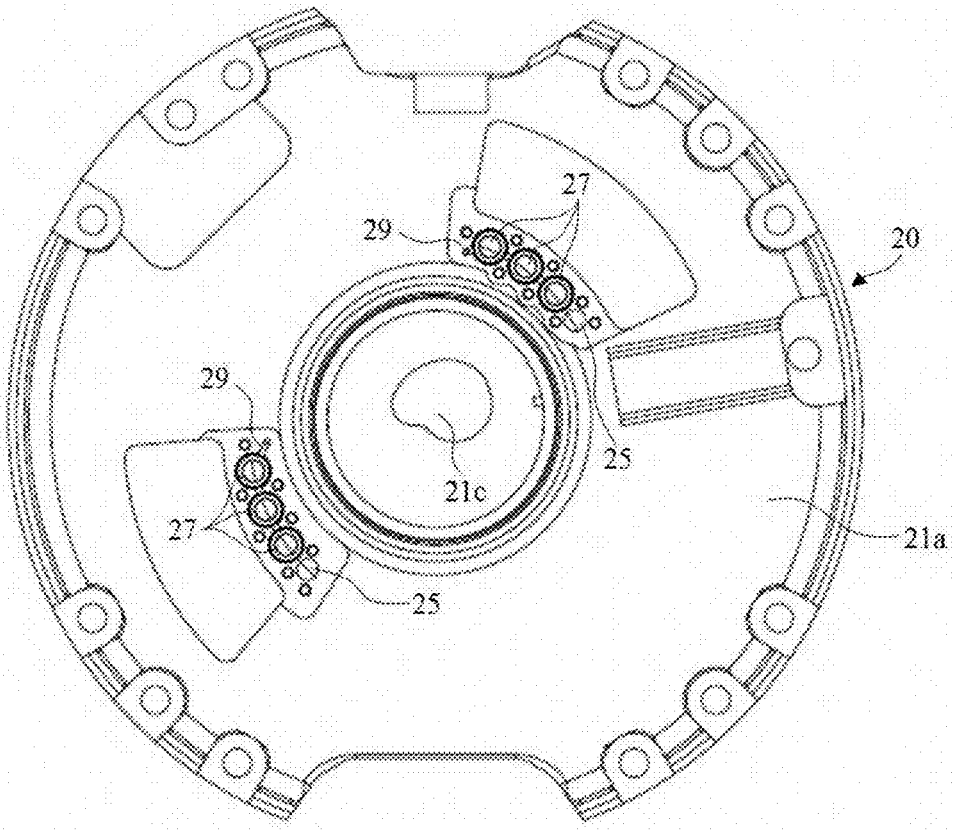
Figure 5:
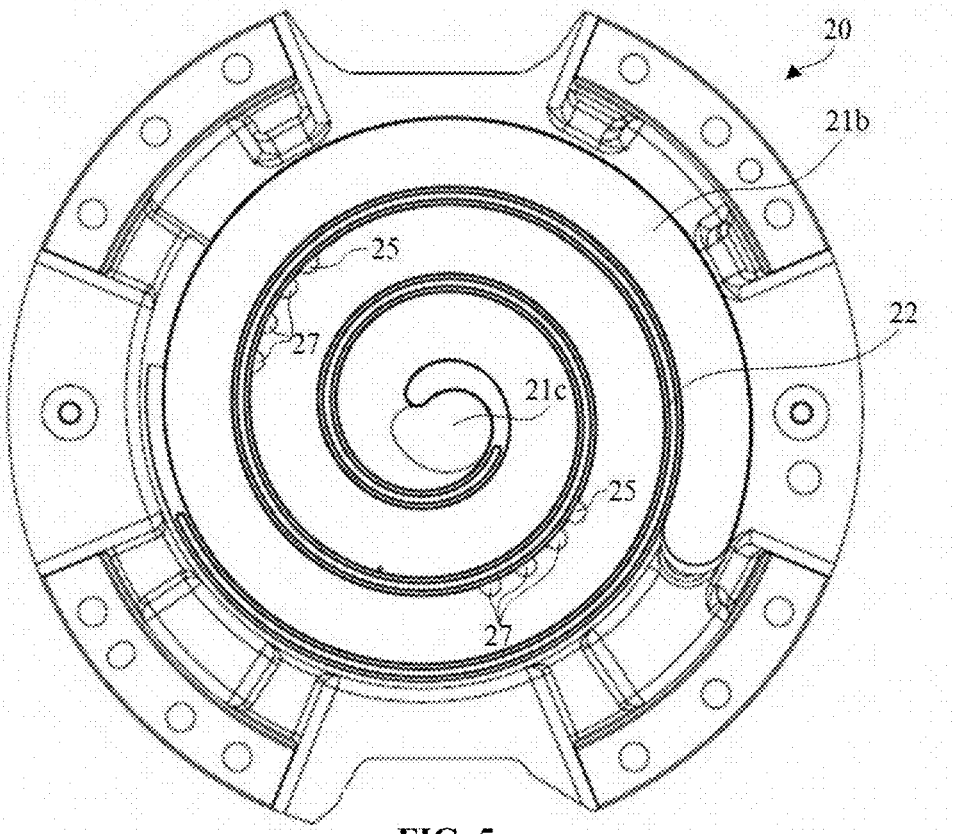
Figure 6:
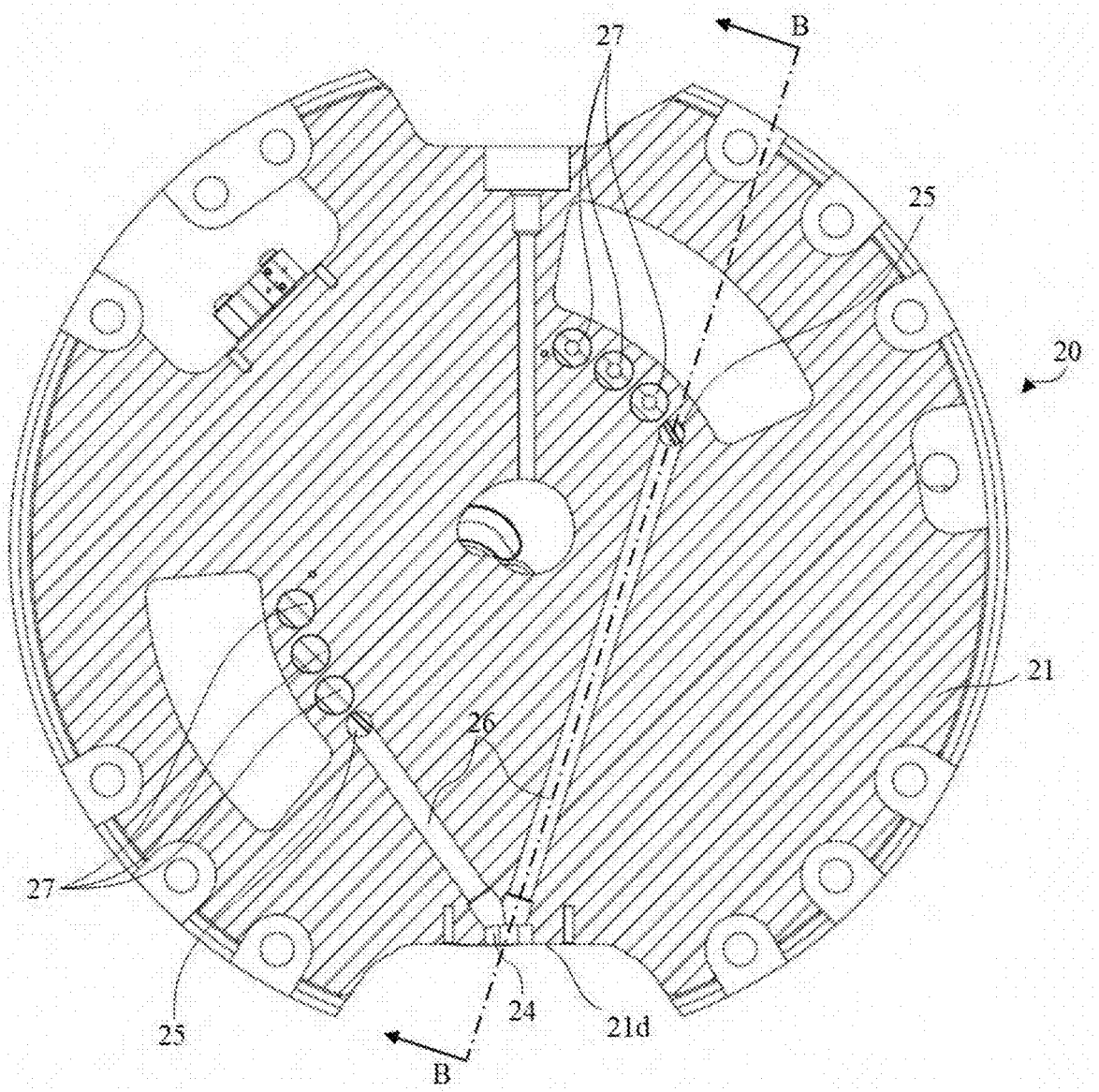
FIG. 6 illustrates a cross-sectional view of the compression mechanism in FIG. 1 taken along line A-A in FIG. 3.

FIG. 1 illustrates a three-dimensional view of a compression mechanism 1 of a scroll compressor according to an embodiment of the present application. The compression mechanism 1 of the scroll compressor includes an orbiting scroll component 10 and a fixed scroll component 20 that cooperate with each other to form a compression chamber. FIG. 2 illustrates an exploded view of a fixed scroll assembly in FIG. 1. The fixed scroll assembly may include the fixed scroll component 20 and a sealing assembly 40 connected to the fixed scroll component 20. FIGS. 3 to 5 illustrate a side view, a top view, and a bottom view of the fixed scroll component 20, respectively; FIG. 6 illustrates a cross-sectional view of the compression mechanism 1 of the scroll compressor taken along line A-A in FIG. 3; and FIG. 7 illustrates a cross-sectional view of the compression mechanism 1 of the scroll compressor taken along line B-B in FIG. 6.

As shown in FIGS. 1 to 5, the fixed scroll component 20 includes an end plate 21 and a fixed scroll 22 extending in an axial direction from a first side of the end plate 21, i.e., from a lower surface 21*b* of the end plate 21. The fixed scroll component 20 may further include a hub portion 23 protruding in an axial direction from an opposite second side of the end plate 21, i.e., from an upper surface 21*a* opposite to the lower surface 21*b*. As shown in FIG. 7, an orbiting scroll component 10 includes an end plate 11 and an orbiting scroll 12 protruding in the axial direction from the upper surface 11*a* of the end plate 11. When the scroll compressor is in operation, a drive mechanism drives the orbiting scroll component 10 to revolve around the fixed scroll component 20, and the orbiting scroll 12 and the fixed scroll 22 mate with each other to form a series of compression chambers between the orbiting scroll 12 and the fixed scroll 22. The compression chambers have gradually decreased volumes from a radially outer side to a radially inner side. As shown in FIG. 5, the fixed scroll 22 defines a helical fluid compression path, and a fluid to be compressed flows into the compression chambers from a radially outer side of the helical fluid compression path. After being compressed, the fluid flows out from an exhaust port 21*c* located at a substantially central position of the end plate 21.

Figure 7:
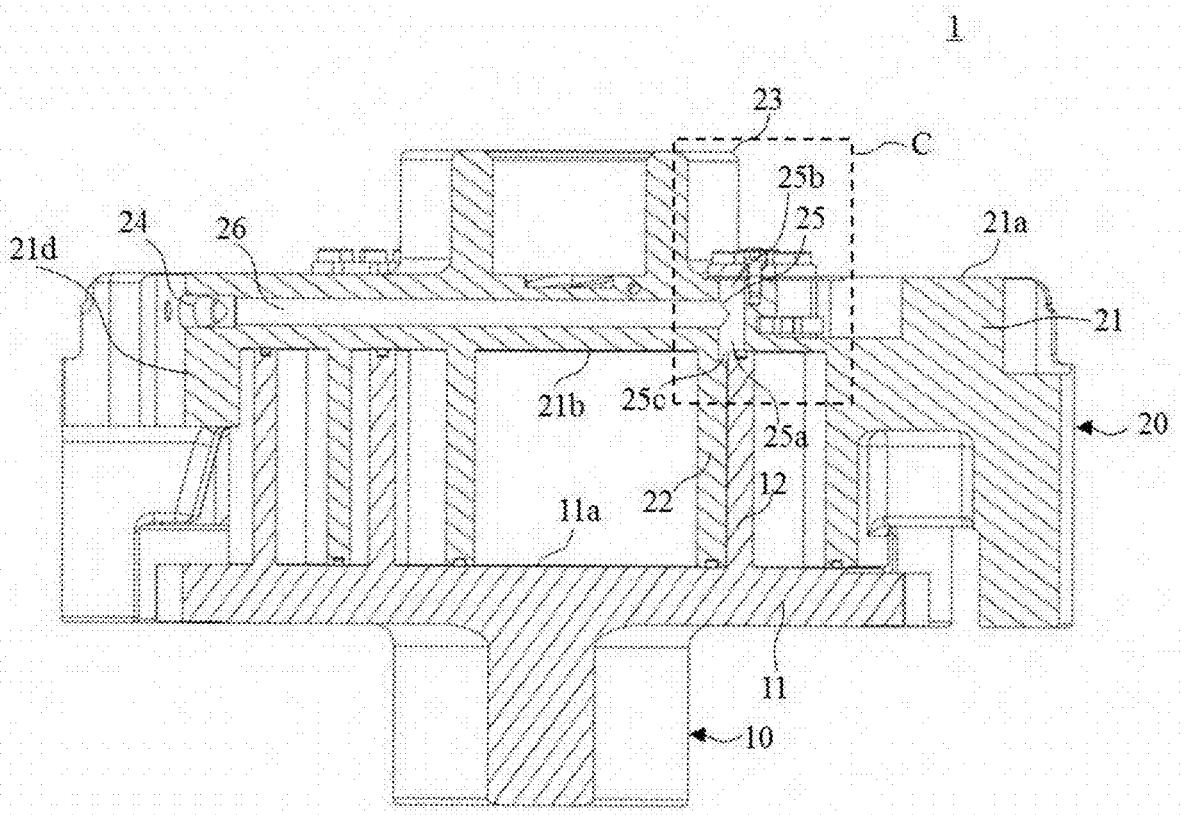
FIG. 7 illustrates a cross-sectional view of the compression mechanism in FIG. 1 taken along line B-B in FIG. 6.

As shown in FIGS. 3 to 7, the fixed scroll component 20 includes an enhanced vapor injection inlet orifice 24 formed at an outer peripheral surface 21*d* of the end plate 21, an enhanced vapor injection jet orifice 25 extending through the end plate 21 from the upper surface 21*a* of the end plate 21 and extending downwardly into the compression chamber, and an enhanced vapor injection passage 26, extending inside the end plate 21, through which the enhanced vapor injection inlet orifice 24 is in communication with the enhanced vapor injection jet orifice 25. In an embodiment, the fixed scroll component 20 includes two enhanced vapor injection jet orifices 25 spaced apart in a circumferential direction of the fixed scroll component 20. In other embodiments, any number of enhanced vapor injection jet orifices may be provided. As shown in FIG. 7, the enhanced vapor injection jet orifice 25 has a first end 25*a* leading to the compression chamber and a second end 25*b* leading to an exterior of the fixed scroll component. When the scroll compressor is in operation, the first end 25*a*, located at the lower surface 21*b* of the end plate 21, of the enhanced vapor injection jet orifice 25 is in fluid communication with the compression chamber, and the second end 25*b*, arranged at the upper surface 21*a* of the end plate 21, of the enhanced vapor injection jet orifice 25 is sealed by the sealing assembly 40. As a result, a certain amount of refrigerant can be replenished to a specified position (i.e., a specified compression chamber) through the enhanced vapor injection inlet orifice 24, the enhanced vapor injection passage 26, and the enhanced vapor injection jet orifice 25, so as to achieve an enthalpy enhancing effect and to improve the performance of the scroll compressor.

As shown in FIGS. 1 and 2, the sealing assembly 40 may include a press plate 41 and a sealing gasket 42 for covering and sealing the enhanced vapor injection jet orifice 25. The scaling gasket 42 is located between the press plate 41 and the enhanced vapor injection jet orifice 25. The sealing assembly 40 may further include multiple bolts 43, which pass through corresponding bolt orifices formed in the sealing gasket 42, the press plate 41, and the upper surface 21*a* of the end plate 21 to fasten and tightly press the sealing gasket 42 and the press plate 41 to the upper surface 21*a* of the end plate 21. In addition to the bolts 43, any other suitable fasteners may be used. In this embodiment, two press plates 41 and two scaling gaskets 42 are provided in correspondence to the two enhanced vapor injection jet orifices 25. In other embodiments, any number of press plates and sealing gaskets may be used, for example, a single press plate and a single sealing gasket may be used to seal multiple enhanced vapor injection jet orifices simultaneously. In other embodiments, any other suitable form of sealing assembly may be used.

As shown in FIG. 7, the enhanced vapor injection jet orifice 25 includes a first part that is not overlapped with the fixed scroll 22 when viewed in the axial direction and a second part that is overlapped with the fixed scroll 22 when viewed in the axial direction. The second part extends through the end plate into the fixed scroll 22. In other words, the second part of the enhanced vapor injection jet orifice 25 includes a recess 25*c* formed by removing a part of material from the lower surface 21*b* of the end plate 21 of the fixed scroll 22 towards the fixed scroll 22.

Figure 8:
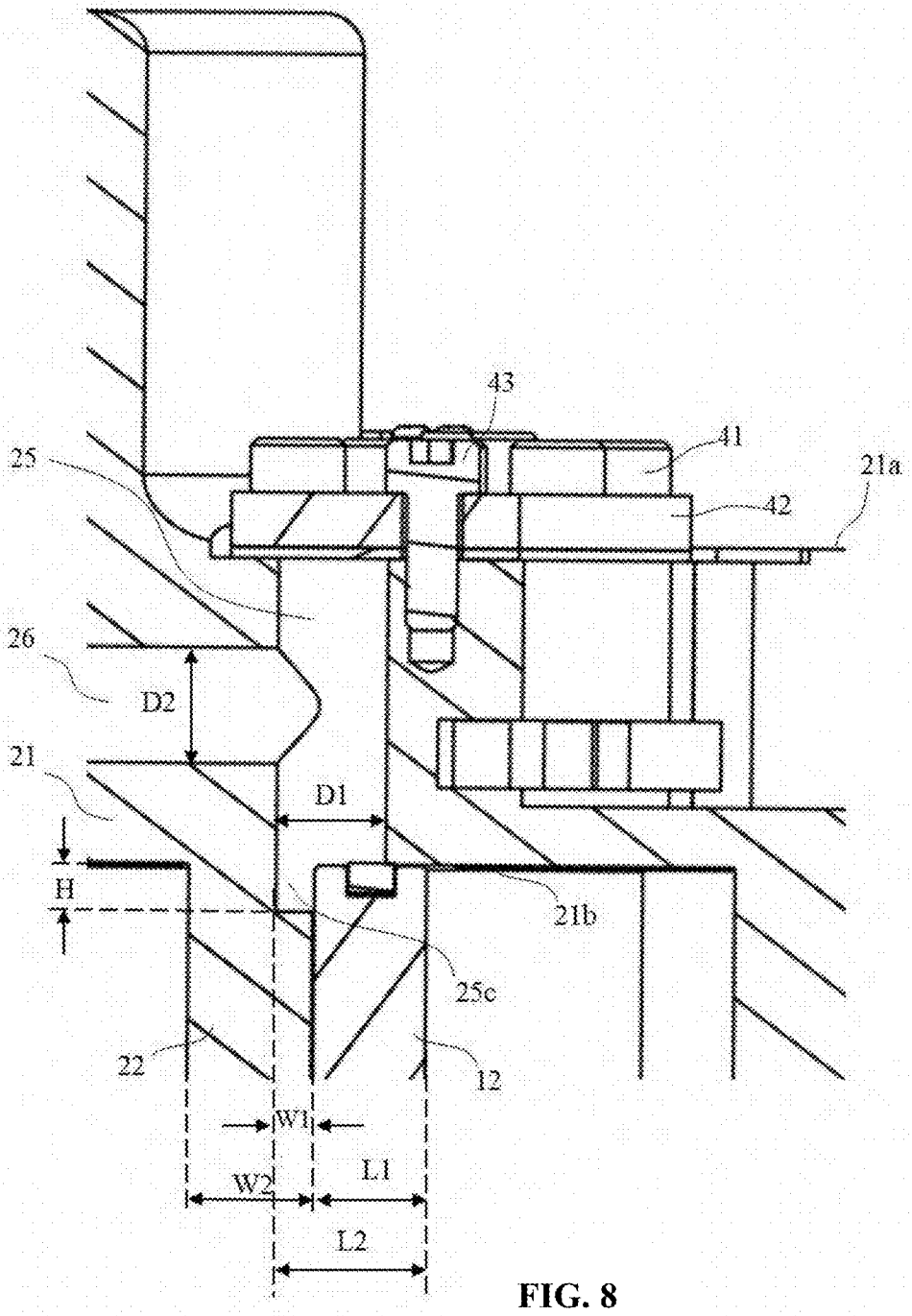
FIG. 8 illustrates an enlarged view of region C in FIG. 7.

FIG. 8 illustrates an enlarged view of region C in FIG. 7. An enhanced vapor injection jet orifice 25 and an enhanced vapor injection passage 26 each having a circular cross-section are shown herein. The diameter D1 of the enhanced vapor injection jet orifice 25 is less than or equal to the diameter D2 of the enhanced vapor injection passage 26. In a case that D1 is equal to D2, the flow path of the enhanced vapor injection fluid may have a constant flow area. In an embodiment, in the thickness direction of the fixed scroll 22, the depth W1 of the recess 25*c* formed by removing a part of the material from the fixed scroll 22 does not exceed two thirds of the thickness W2 of the fixed scroll 22, to ensure that the fixed scroll 22 still has sufficient stiffness. In an embodiment, the height H of the recess 25*c* along the axial direction is greater than or equal to the radius of the enhanced vapor injection jet orifice 25, i.e., $H \geq 1/2D1$, to realize the flow area as greater as possible.

Although the various orifices or passages herein, such as the enhanced vapor injection inlet orifice, the enhanced vapor injection jet orifice, the enhanced vapor injection passage, and the bypass orifice, are illustrated as orifices or passages having a circular cross-section, it should be understood that the present application is not limited to a particular orifice shape and passage shape. In other embodiments, any other suitably shaped orifices or passages may be used. For an orifice or a passage having a non-circular cross-section, the diameter or radius of the orifice or passage described herein should be understood to be the hydraulic diameter or hydraulic radius of the orifice or passage. The hydraulic diameter refers to the ratio of four times the cross sectional area of the overflow of the orifice or passage to the perimeter of the overflow, and the hydraulic radius is the ratio of the cross sectional area of the overflow of the orifice or passage to the perimeter of the overflow.

As shown in FIG. 8, in the conventional technology, an enhanced vapor injection jet orifice is typically drilled from the lower surface 21*b* of the end plate 21 of the fixed scroll component 20 (i.e., from the profile side of the fixed scroll 22), which requires that the enhanced vapor injection jet orifice avoids the profile of the fixed scroll 22 and is not allowed to extend beyond the width of the profile of the orbiting scroll 12, so as to prevent leakage of fluid in a compression chamber that is in fluid communication with the enhanced vapor injection jet orifice to another adjacent compression chamber. As a result, the size and flow area of the enhanced vapor injection jet orifice in the conventional technology are limited. FIG. 8 illustrates the maximum size L1 of the enhanced vapor injection jet orifice in this case in the thickness direction of the fixed scroll 22 and the orbiting scroll 12. In contrast, the enhanced vapor injection jet orifice 25 is drilled from the upper surface 21*a* of the end plate 21 of the fixed scroll component 20 according to the present embodiment, which effectively avoids the fixed scroll 22 from obstructing the drilling process. Further, in the present application, the enhanced vapor injection jet orifice 25 can be arranged by utilizing a part of the thickness of the fixed scroll 22, to increase the size and flow area of the enhanced vapor injection jet orifice 25. FIG. 8 illustrates the maximum size L2 of the enhanced vapor injection jet orifice 25 in the thickness direction of the fixed scroll 22 and the orbiting scroll 12 according to the present application, and it can be seen that $L2=L1+W1$. In other words, the maximum size L2 of the enhanced vapor injection jet orifice 25 of the scroll compressor according to the present application in the thickness direction of the fixed scroll 22 and the orbiting scroll 12 has increased by the depth WI of the recess 25*c* formed by removing a part of material from the fixed scroll 22 compared to the corresponding maximum size L1 of the enhanced vapor injection jet orifice in the conventional scroll compressor. The depth W1 may be two thirds of the thickness W2 of the fixed scroll 22. For a circular orifice, the maximum sizes L1 and L2 may be understood as the diameter of the orifice. For a non-circular orifice, the maximum dimensions L1 and L2 may limit the hydraulic diameter and the flow area of the orifice. Compared to a conventional scroll compressor, the hydraulic diameter of the enhanced vapor injection jet orifice of the scroll compressor according to the embodiments of the present application may be increased to at least two times, and the flow area of the enhanced vapor injection jet orifice may be increased to at least four times.

The scroll compressor may further include a variable displacement structure integrally designed with the enhanced vapor injection structure for changing the displacement of the scroll compressor without changing the rotating speed of the scroll compressor.

As shown in FIGS. 2 to 6, the fixed scroll component 20 further includes one or more bypass orifices 27 arranged adjacent to the enhanced vapor injection jet orifice 25. The bypass orifices 27 are located substantially at the mid-section of the helical fluid compression path illustrated in FIG. 5 and extend from the upper surface 21*a* of the end plate 21 over the lower surface 21*b*, thereby extending through the end plate 21 into the compression chamber. The bypass orifices 27 and the enhanced vapor injection jet orifices 25 are arranged in groups at the upper surface 21*a* of the end plate 21 and may be sealed by a common sealing assembly 40. In this embodiment, two groups of bypass orifices 27 spaced apart in a circumferential direction are provided corresponding to the two enhanced vapor injection jet orifices 25. Each group of bypass orifices 27 includes three bypass orifices 27. In other embodiments, any number and group of bypass orifices may be provided. The displacement of the scroll compressor can be changed by selectively enable the bypass orifices 27 to be in fluid communication with a low-pressure region external to the fixed scroll component 20 or disconnecting the bypass orifices 27 from the low-pressure region. When the bypass orifices 27 are blocked, the scroll compressor operates in a fully-loaded operating state, and when the bypass orifices 27 are in fluid communication with the exterior of the fixed scroll component 20, thereby enabling the corresponding compression chamber to be in fluid communication with the low-pressure region of the scroll compressor. In this case, the scroll compressor operates in a partially-loaded operating state.

As shown in FIGS. 1 and 2, an exhaust slot 28 is provided on a side of each group of bypass orifices 27, and the exhaust slot 28 extends into each of the bypass orifices of the group of bypass orifices 27 so that each of the bypass orifices in the group of bypass orifices 27 is capable of being in communication with each other and to the exterior of the fixed scroll component 20 via the exhaust slot 28. In this embodiment, the exhaust slot 28 is provided on a side wall 21*f*, adjacent to the bypass orifices 27, of the recess 21*e* recessed downwardly from the upper surface 21*a* of the end plate 21. As shown in FIG. 2, the sealing assembly 40 may further include a piston 44. An upper portion of the bypass orifice 27 defines a piston chamber 27*a*, and the piston 44 is arranged in the piston chamber 27*a* and is movable in a vertical direction between a first position and a second position in the piston chamber 27*a*. When the piston 44 is raised to the first position, the bypass orifice 27 is in fluid communication with the exhaust slot 28, allowing fluid in the corresponding compression chamber to be discharged via the bypass orifice 27 and the exhaust slot 28 to a low-pressure region external to the fixed scroll component 20, thereby allowing the scroll compressor to operate in a partially-loaded operating condition. When the piston 44 is lowered to the second position, a passage between the bypass orifice 27 and the exhaust slot 28 is blocked by the piston 44, the corresponding compression chamber is disconnected from the low-pressure region, and the scroll compressor operates in a fully-loaded operating state.

As shown in FIGS. 2 and 4, a communication groove 29 may be further provided on the upper surface 21*a* of the end plate 21 of the fixed scroll component 20, the communication groove 29 is arranged around each of the bypass orifices in each group of bypass orifices 27 and is configured to keep the group of bypass orifices in communication with each other. The communication groove 29 also allows the bypass orifices 27 to be fluid communication with a high-pressure region. The pressure of the fluid in the high-pressure region is greater than the pressure of the fluid in the compression chamber in communication with the corresponding bypass orifices 27. In the assembled state, the bypass orifices 27 and the communication groove 29 are covered and sealed at the upper surface 21*a* of the end plate 21 by the press plate 41 and the sealing gasket 42. By the provision of the communication groove 29, fluid having a predetermined pressure can be introduced simultaneously to upper surfaces of all pistons 44 in a group of bypass orifices 27, thereby changing the pressure difference between positions above and below the piston 44, to simultaneously control the movement of all pistons 44 in each group of bypass orifices 27. In other embodiments, a communication groove for keep all the bypass orifices in communication with each other may be provided.

As shown in FIGS. 1 and 2, the scroll compressor may further include a fluid control device 50, configured to introduce a fluid having a predetermined pressure to the upper surface of the piston 44, control the movement of the piston 44 by controlling the pressure difference between the positions above and below the piston 44, and thus control the switching of the scroll compressor between a fully-loaded operating state and a partially-loaded operating state. In this embodiment, the fluid control device 50 includes a solenoid valve. In other embodiments, the fluid control device 50 may include any other suitable valve and/or other mechanism. A first fluid passage 31, a second fluid passage 32 and a third fluid passage 33 for connecting with the fluid control device 50 are provided in the end plate 21 of the fixed scroll component 20. In this embodiment, a recess 21*g* for receiving and accommodating the fluid control device 50 is provided on an outer peripheral surface 21*d* of the end plate 21, and the first fluid passage 31, the second fluid passage 32 and the third fluid passage 33 extend at the recess 21*g* from the outer peripheral surface 21*d* of the end plate 21 to the interior of the end plate 21. The first fluid passage 31 extends into a predetermined high-pressure region in the compression chamber. The high-pressure region of the fixed scroll component 20 may be located radially inside the bypass orifices 27 on the helical fluid compression path, i.e. the high-pressure region is closer to the center of the fixed scroll component 20 than each of the bypass orifices 27. As a result, the pressure of the fluid in the high-pressure region is greater than the pressure of the fluid in the compression chamber in fluid communication with the bypass orifices 27. The second fluid passage 32 and the third fluid passage 33 are in fluid communication with a corresponding communication groove 29 of each of the two groups of bypass orifices 27. A fluid control device 50 is provided between the first fluid passage 31 and the second fluid passage 32, and between the first fluid passage 31 and the third fluid passage 33, and is configured to selectively enable the first fluid passage 31 to be in fluid communication with the second fluid passage 32 and the third fluid passage 33 or disconnect the first fluid passage 31 from the second fluid passage 32 and the third fluid passage 33. When the first fluid passage 31 is in fluid communication with the second fluid passage 32 and the third fluid passage 33, high-pressure fluid from the high-pressure region flows through the first fluid passage 31, the second fluid passage 32, the third fluid passage 33, and the communication groove 29 into the piston chamber 27*a* of the bypass orifice 27 and acts on the upper surface of the piston 44, the pressure at the position above the piston 44 is greater than the pressure at the position below the piston 44, and the piston 44 descends to the second position and blocks fluid communication between the bypass orifice 27 and the exhaust grove 28. When the first fluid passage 31 is disconnected from the second fluid passage 32 and the third fluid passage 33, the high-pressure fluid, provided above the piston 44, in the piston cavity 27*a* of each bypass orifice 27 is discharged via a fluid path in the fluid control device 50 such that the pressure at the position below the piston 44 is greater than the pressure at the position above the piston 44. As a result, the piston 44 is moved upwardly to the first position to keep the bypass orifices 27 in fluid communication with the exhaust slot 28, and fluid in the corresponding compression chamber can flow out through the bypass orifices 27 and the exhaust slot 28.

Figure 9:
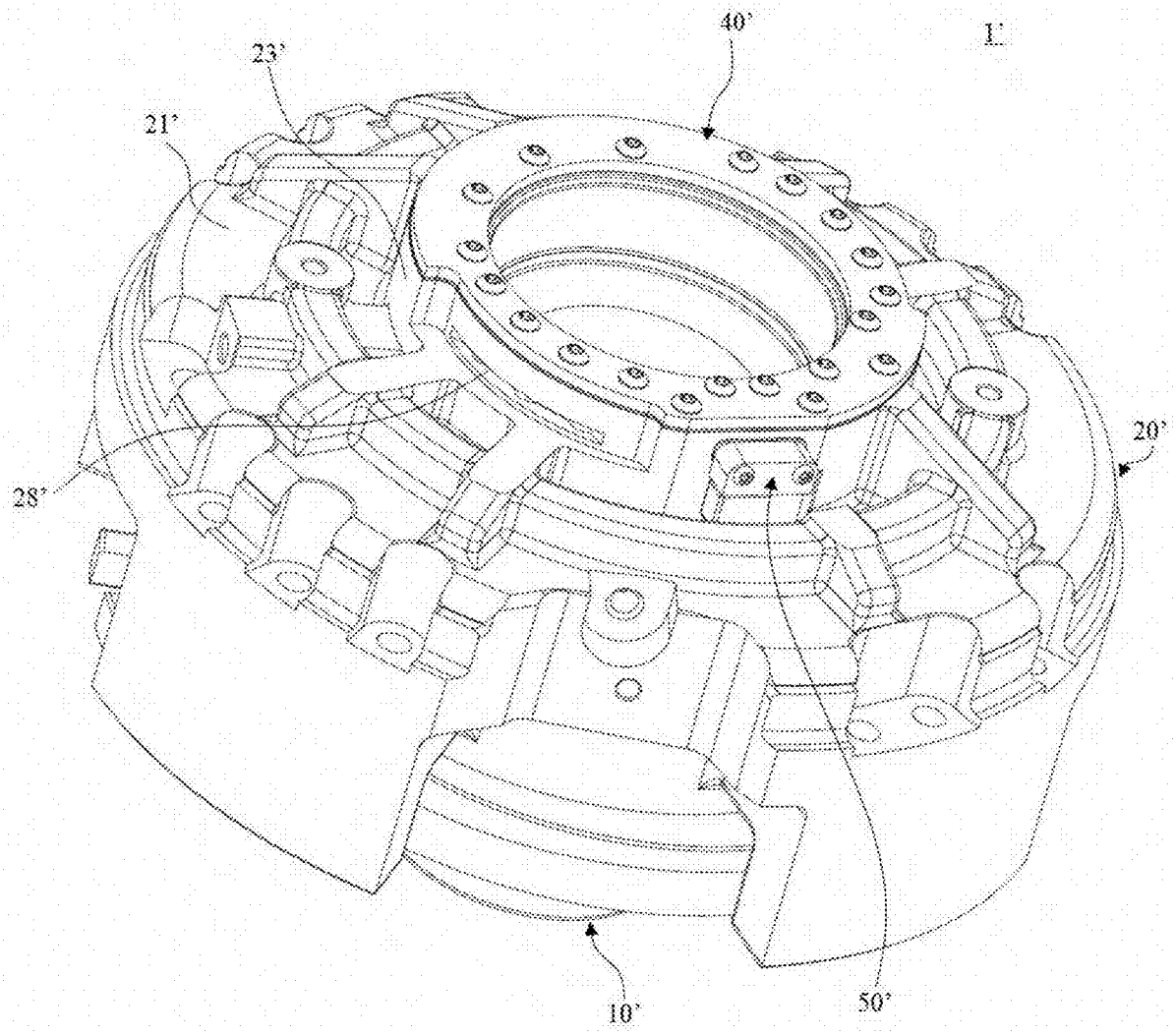
FIG. 9 illustrates a three-dimensional view of a compression mechanism of a scroll compressor according to another embodiment of the present application.
Figure 10:
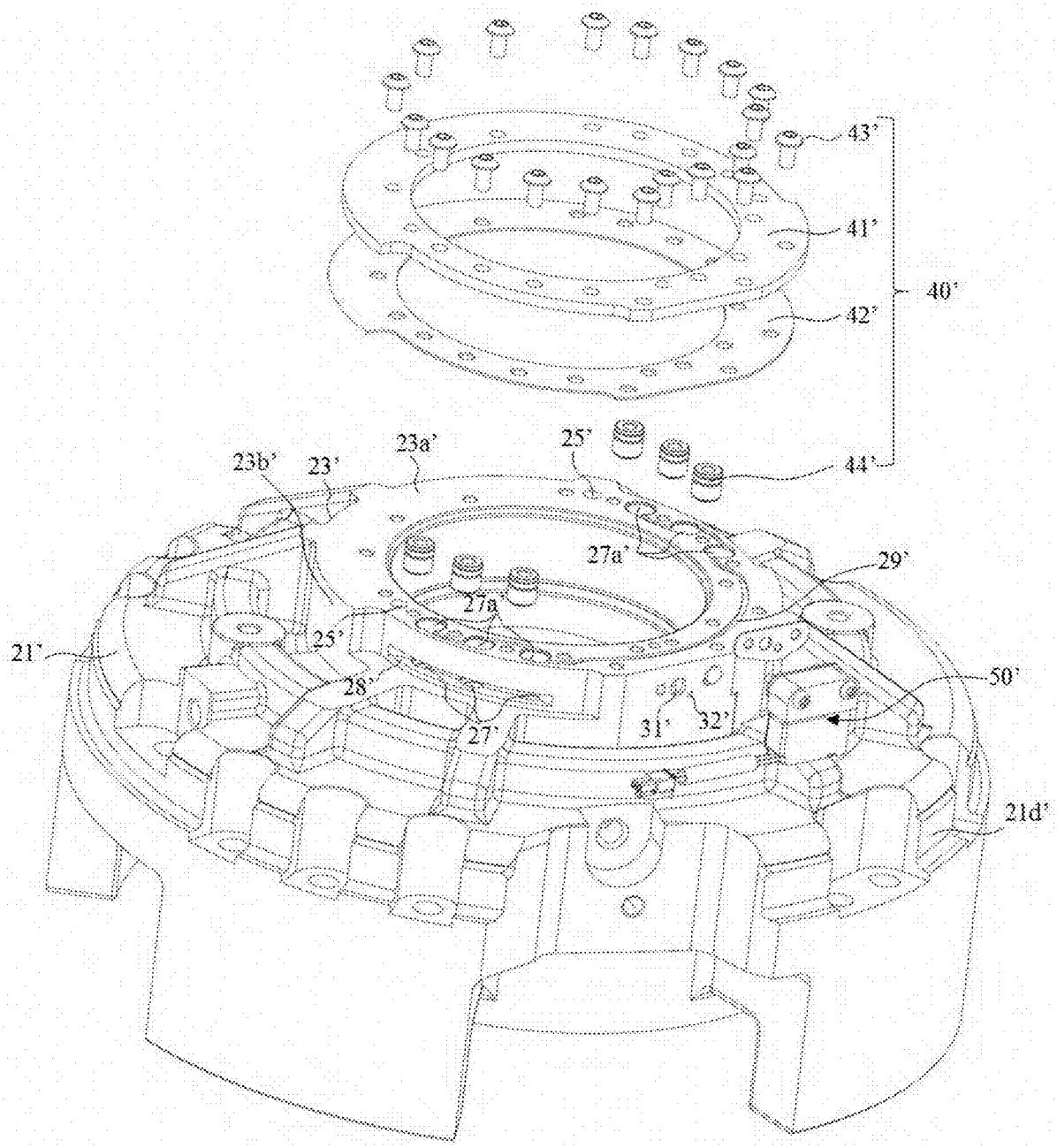
FIG. 10 illustrates an exploded view of a fixed scroll assembly in FIG. 9.

FIGS. 9 to 10 illustrate a scroll compressor according to another embodiment of the present application. The differences between the scroll compressor and the scroll compressor described above will be mainly described hereinafter, in which the same or corresponding features or components are indicated by the same reference numerals with an apostrophe.

FIG. 9 illustrates a three-dimensional view of a compression mechanism 1' of a scroll compressor. The compression mechanism 1' includes an orbiting scroll component 10' and a fixed scroll component 20' that mate with each other to form a compression chamber. FIG. 10 illustrates an exploded view of a fixed scroll assembly in FIG. 9. The fixed scroll assembly may include the fixed scroll component 20' and a sealing assembly 40' and/or a fluid control device 50' connected to the fixed scroll component 20'.

As shown in FIG. 10, the fixed scroll component 20' includes two enhanced vapor injection jet orifices 25' spaced apart from each other and two groups of bypass orifices 27' arranged adjacent to the enhanced vapor injection jet orifices 25' respectively. Each of the enhanced vapor injection jet orifices 25' and the bypass orifices 27' extends downwardly from an upper surface 23*a'* of a hub portion 23' of the fixed scroll component 20' through the hub portion 23' and an end plate 21' until the enhanced vapor injection jet orifices 25' and the bypass orifices 27' are in fluid communication with the compression chamber. Similar to the previous embodiment, each enhanced vapor injection jet orifice 25' may include a first part that is not overlapped with the fixed scroll when viewed in the axial direction and a second part that is overlapped with the fixed scroll when viewed in the axial direction. The second part extends through the end plate 21' into the fixed scroll (not shown) to expand the flow area of the enhanced vapor injection jet orifice 25'.

Similar to the fixed scroll component 20 in the previous embodiment, in the present embodiment, an enhanced vapor injection inlet orifice (not shown) is likewise formed at an outer peripheral surface 21*d'* of the end plate 21' of the fixed scroll component 20', and an enhanced vapor injection passage (not shown), through which the enhanced vapor injection inlet orifice and the enhanced vapor injection jet orifice 25' are connected, is likewise formed inside the end plate 21' of the fixed scroll component 20'. However, the present application is not limited thereto. In other embodiments, the enhanced vapor injection inlet orifice and the enhanced vapor injection passage may be arranged at other locations, for example, on the hub portion of the fixed scroll component.

Two exhaust slots 28' are provided on an outer peripheral surface 23*b'* of the hub portion 23', and each exhaust slot 28' extends into each bypass orifice of a corresponding group of bypass orifices 27', so that the bypass orifices 27' in the group of bypass orifices 27' can be in communication with each other and with the exterior of the fixed scroll component 20' via the exhaust slot 28'. In other embodiments, an exhaust slot that allows all of the bypass orifices 27' to be in communication with each other and with the exterior of the fixed scroll component 20' may be provided. A communication groove 29' that allow all the bypass orifices 27' to be in communication with each other is provided on the upper surface 23*a'* of the hub portion 23'.

The sealing assembly 40' includes a substantially ring-shaped press plate 41' and a scaling gasket 42'. The press plate 41' and the scaling gasket 42' cover the upper surface 23*a'* of the hub portion 23' and cover and seal all of the enhanced vapor injection jet orifices 25' and bypass orifices 27'. The sealing assembly 40' may further include: multiple bolts 43' or other fastening structures configured to fasten and tightly press the press plate 41' and the sealing gasket 42' to the upper surface 23*a'* of the hub portion 23'; and a piston 44' which is movable in a vertical direction in a piston chamber 27*a'* of each bypass orifice 27'.

As shown in FIGS. 9 and 10, in this embodiment, the fluid control device 50' is arranged on the outer peripheral surface 23*b'* of the hub portion 23' of the fixed scroll component 20'. Accordingly, a first fluid passage 31' and a second fluid passage 32' for connecting with the fluid control device 50' extend from the outer peripheral surface 23*b'* of the hub portion 23' to the interior of the hub portion 23'. The first fluid passage 31' is in fluid communication with a predetermined high-pressure region in the compression chamber. The high-pressure region is closer to the center of the fixed scroll component 20' than each of the bypass orifices 27'. The second fluid passage 32' is in fluid communication with a communication groove 29' configured to allow all of the bypass orifices 27' to be in communication with each other. Similar to the fluid control device 50 in the previous embodiment, the fluid control device 50' is arranged between the first fluid passage 31' and the second fluid passage 32' and is configured to selectively enable the first fluid passage 31' to be in fluid communication with the second fluid passage 32' or disconnect the first fluid passage 31' from the second fluid passage 32', thereby changing the pressure difference between positions above and below the piston 44' to move the piston 44' in a vertical direction in the piston chamber 27*a'* of the bypass orifice 27', thereby controlling the scroll compressor to switch between a fully-loaded operating state and a partially-loaded operating state.

A method for machining the fixed scroll component according to the above aspects is provided according to another aspect of the present application. The method may include: machining, in a fixed scroll component, at least one enhanced vapor injection jet orifice extending from an upper surface of the fixed scroll component to a compression chamber. An enhanced vapor injection fluid external to a compressor including the fixed scroll assembly is capable of being supplied into the compression chamber via the enhanced vapor injection jet orifice. The enhanced vapor injection jet orifice has a first end leading to the compression chamber and a second end leading to an exterior of the fixed scroll assembly. The method may further include: manufacturing a scaling assembly, configured to seal the second end of the enhanced vapor injection jet orifice. The method may further include the corresponding steps of machining features such as the bypass orifice, the exhaust slot, and the communication groove in the preceding embodiments. The steps described above are not necessarily performed in the order described herein.

As described above, according to the embodiments of the present application, the enhanced vapor injection jet orifices are drilled from the upper surface of the fixed scroll component (e.g., the upper surface of the end plate or the upper surface of the hub portion), and a part of the thickness of the fixed scroll can be utilized for arranging the enhanced vapor injection jet orifices, which significantly simplifies the machining process of the fixed scroll assembly and can significantly increase the size and flow area of the enhanced vapor injection jet orifices without impairing the sealing performance of the scroll compressor. Compared to a conventional scroll compressor, the hydraulic diameter of the enhanced vapor injection jet orifice of the scroll compressor according to an embodiment of the present application may be increased to at least two times, and the flow area of the enhanced vapor injection jet orifice can be increased to at least four times. In addition, in the present application, an enhanced vapor injection structure of the scroll compressor is integrated with a variable displacement structure so that the enhanced vapor injection jet orifice and the bypass orifice can be sealed by a common sealing assembly. This simplifies the structure and machining process of the scroll compressor and reduces the number of required sealing members. In particular, by arranging the enhanced vapor injection jet orifice and the bypass orifice on the upper surface of the hub portion of the fixed scroll component and by providing a single communication groove enabling all the bypass orifices to be in communication with each other, a single press plate and a single sealing gasket can be used to seal the orifices and the communication groove, which can further simplify the structure and machining process of the scroll compressor and further reduce the number of required scaling parts.

A scroll compressor according to another embodiment of the present application is described next with reference to FIGS. 11 to 22. The scroll compressor may include a housing, a compression mechanism 1X accommodated in the housing, a drive mechanism for driving the compression mechanism, and the like. For the sake of simplicity, only the compression mechanism 1X of the scroll compressor is shown herein, and other well-known structures of the scroll compressor are not shown.

Figure 11:
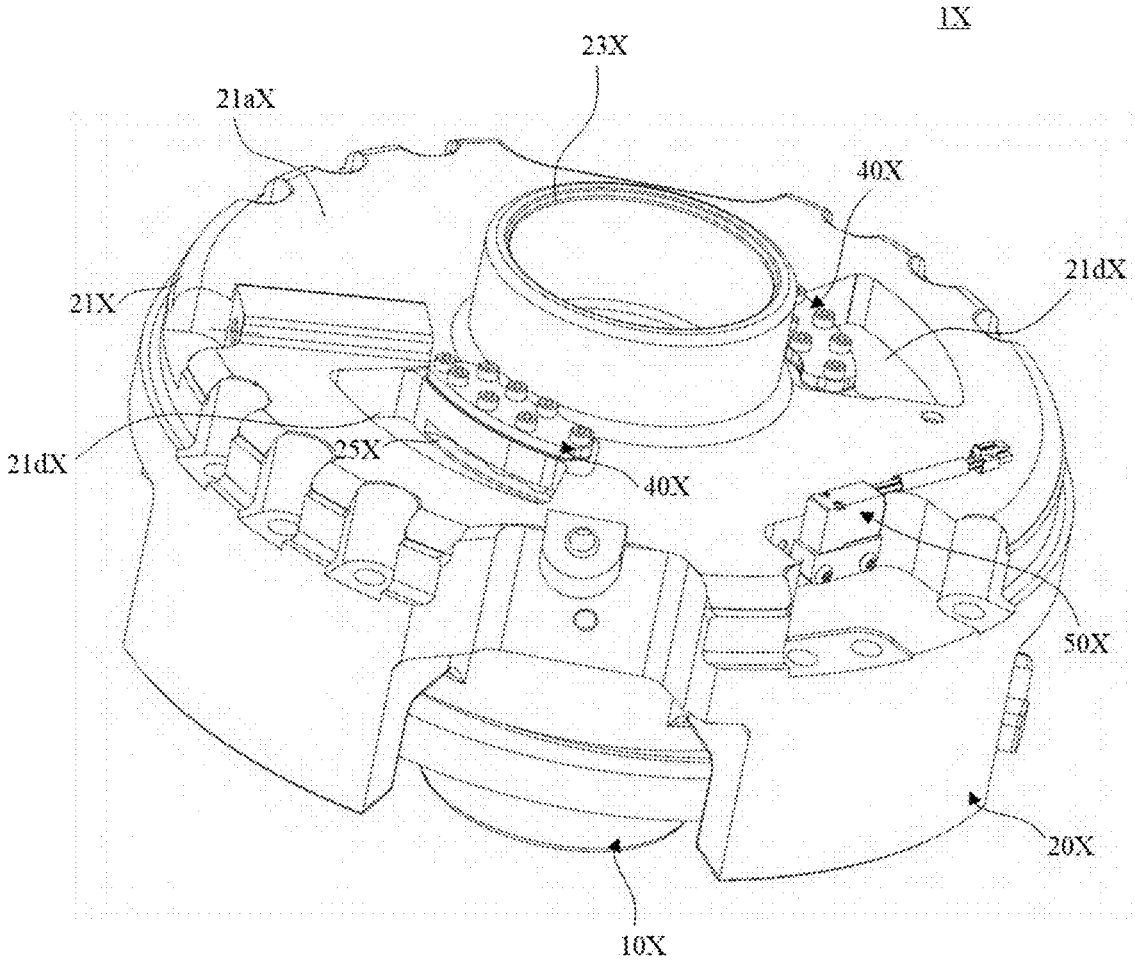
FIG. 11 illustrates a three-dimensional view of a compression mechanism of a scroll compressor according to yet another embodiment of the present application.
Figure 12:
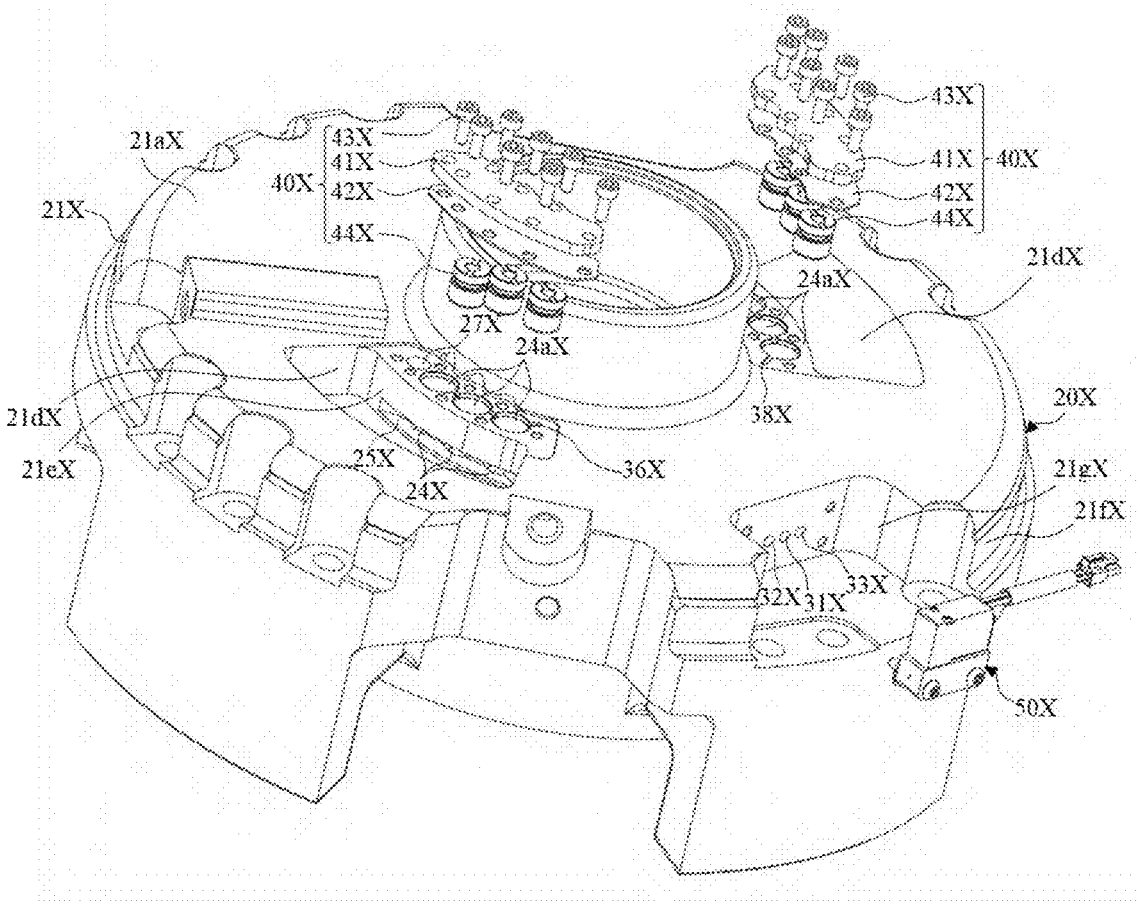
FIG. 12 illustrates an exploded view of a fixed scroll assembly in FIG. 11.
Figure 13:
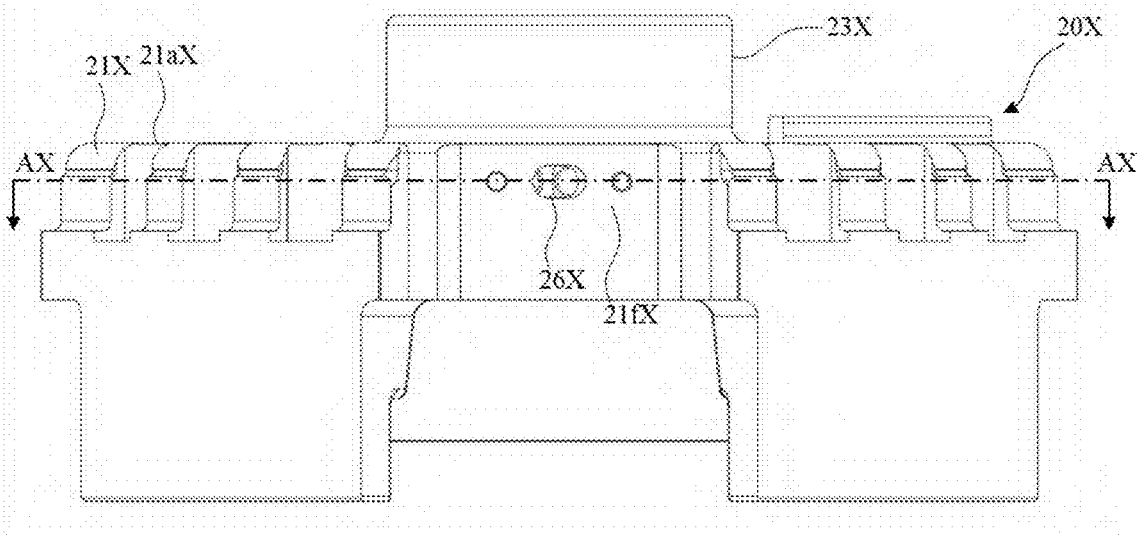
FIGS. 13 to 15 illustrate a front view, a top view, and a bottom view of a fixed scroll component in FIG. 11, respectively.
Figure 14:
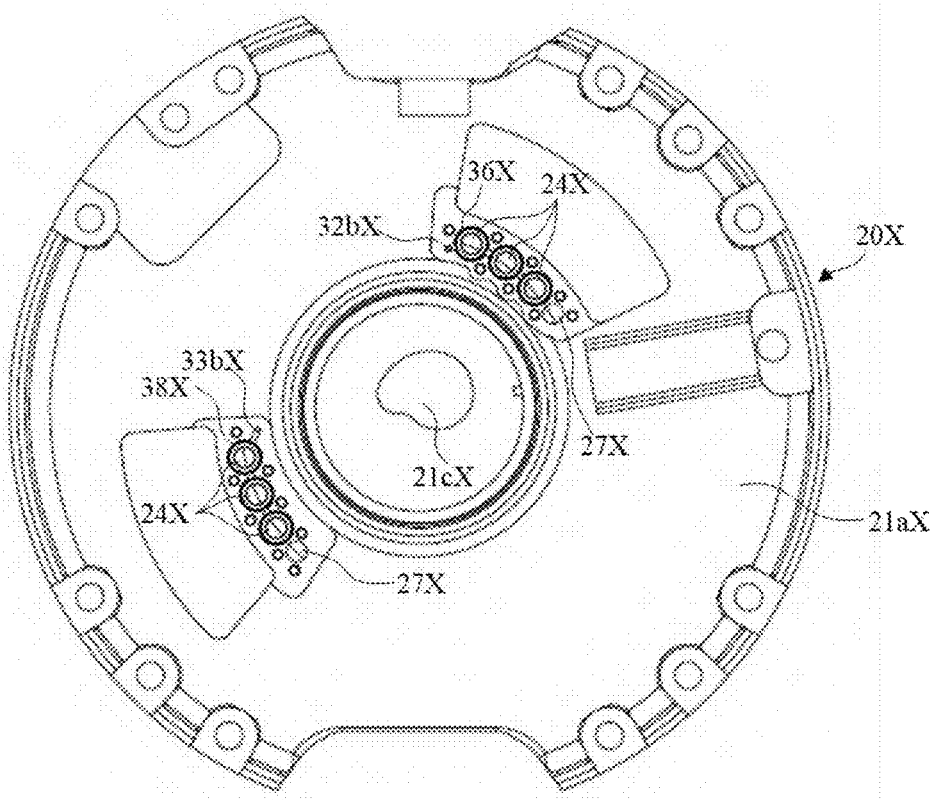
Figure 15:
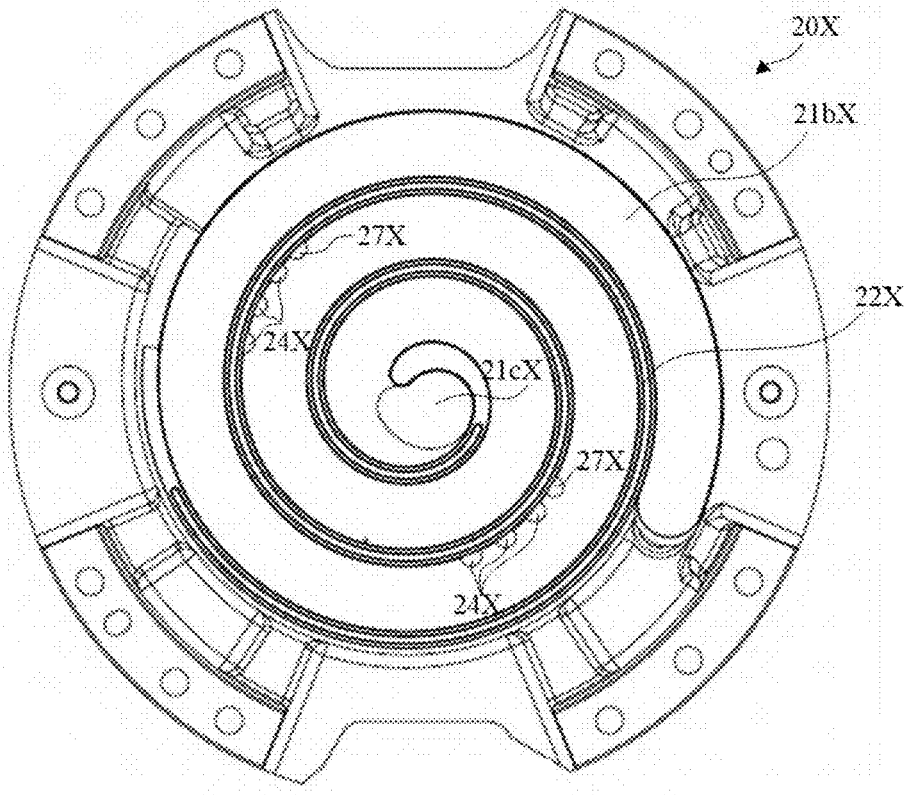

FIG. 11 illustrates a three-dimensional view of the compression mechanism 1X of a scroll compressor according to an embodiment of the present application. The compression mechanism 1X of the scroll compressor includes an orbiting scroll component 10X and a fixed scroll component 20X that mate with each other to form a compression chamber. FIG. 12 illustrates an exploded view of a fixed scroll assembly including the fixed scroll component 20X in FIG. 11. As shown in FIG. 12, the fixed scroll assembly may include a fixed scroll component 20X and a sealing assembly 40X connected to the fixed scroll component 20X. FIGS. 13 to 15 illustrate a front view, a top view, and a bottom view of the fixed scroll component 20X, respectively; and FIGS. 16 and 17 illustrate a cross-sectional view of a compression mechanism 1X of a scroll compressor.

As shown in FIGS. 11 to 15, the fixed scroll component 20X includes an end plate 21X and a fixed scroll 22X extending in an axial direction from a lower surface 21*b*X of the end plate 21X. The fixed scroll component 20X may further include a hub portion 23X protruding in the axial direction from an upper surface 21*a*X of the end plate 21X. As shown in FIG. 17, the orbiting scroll component 10X includes an end plate 11X and an orbiting scroll 12X extending in the axial direction from an upper surface 11*a*X of the end plate 11X. When the scroll compressor is in operation, a driving mechanism drives the orbiting scroll component 10X to revolve relative to the fixed scroll component 20X, and the orbiting scroll 12X and the fixed scroll 22X mate with each other to form a series of compression chambers between the orbiting scroll 12X and the fixed scroll 22X. The compression chambers have gradually decreased volume from a radially outer side to a radially inner side. As shown in FIG. 15, the fixed scroll 22X defines a helical fluid compression path. In a fully-loaded operating state of the scroll compressor, the fluid to be compressed flows in from the radially outer side of the helical fluid compression path, and after being compressed, the fluid flows out of an exhaust port 21*c*X located at a substantially central position of the end plate 21X. One or more bypass orifices 24X extending downwardly from the upper surface 21*a*X of the end plate 21X through the end plate 21X into the compression chamber are provided at the midsection of the helical fluid compression path. In this embodiment, two groups of bypass orifices spaced apart in the circumferential direction are provided, and each group of the bypass orifices comprises three bypass orifices 24X. In other embodiments, any number and groups of bypass orifices may be provided. In addition, the bypass orifice may be circular or in any other suitable shape. By selectively enabling the bypass orifices 24X to be in fluid communication with the exterior of the fixed scroll component 20X or disconnect the bypass orifices 24X from the exterior of the fixed scroll component 20X, the displacement of the scroll compressor can be changed. When the bypass orifices 24X are blocked, the scroll compressor operates in a fully-loaded operating state. When the bypass orifices 24X are in fluid communication with the exterior of the fixed scroll component 20X, thereby enabling the corresponding compression chamber to be in fluid communication with the low-pressure region of the scroll compressor, the scroll compressor operates in a partially-loaded operating state. As shown in FIGS. 11 and 12, an exhaust slot 25X is provided on a side of each group of bypass orifices 24X, and the exhaust slot 25X extends into each of the bypass orifices 24X of the group of bypass orifices 24X so that the bypass orifices 24X of the group of bypass orifices 24X is capable of being in communication with each other and with the exterior of the fixed scroll component 20X via the exhaust slot 25X. As shown in FIG. 12, in this embodiment, the exhaust slot 25X is provided on a side wall 21*e*X, adjacent to the bypass orifice 24X, of a recess 21*d*X recessed downwardly from the upper surface 21*a*X of the end plate 21X.

Figure 16:
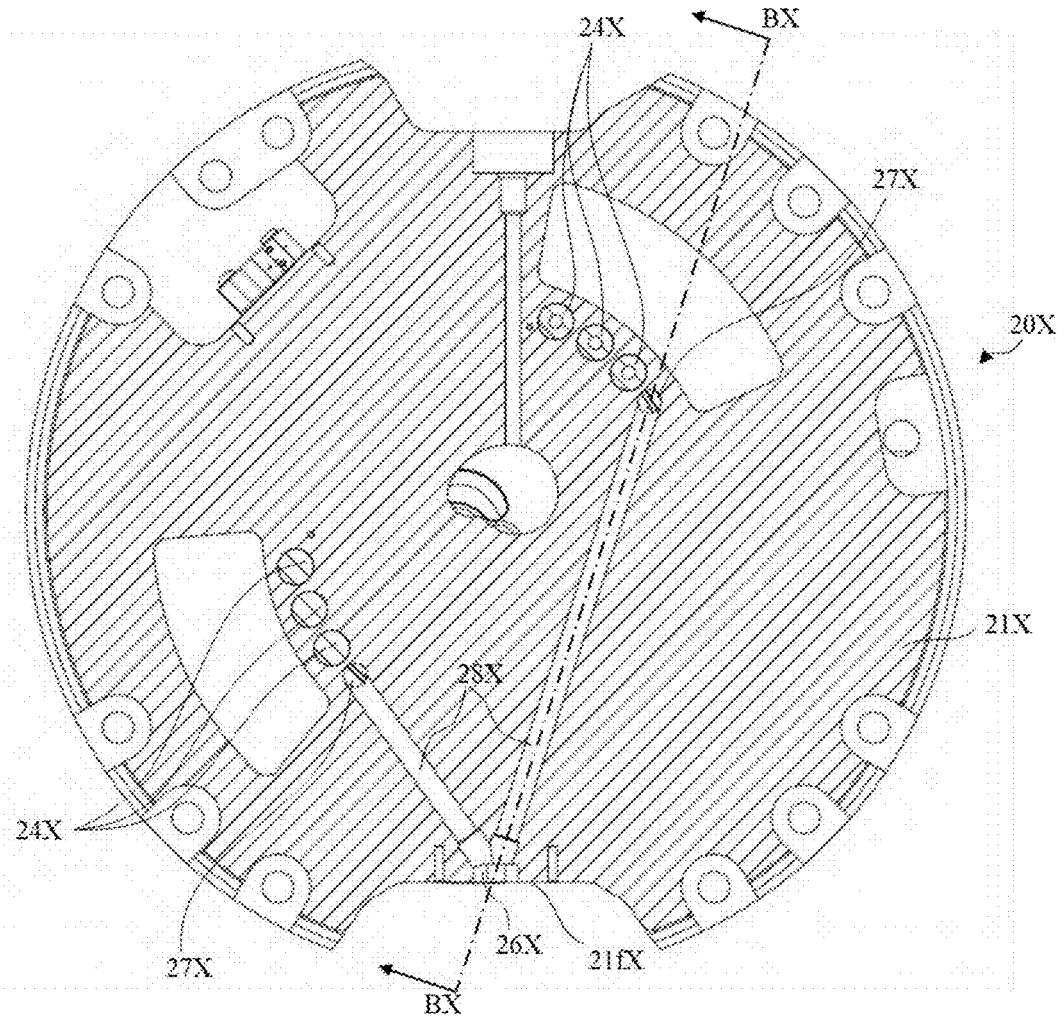
FIG. 16 illustrates a cross-sectional view of a compression mechanism in FIG. 11 taken along line AX-AX in FIG. 13.
Figure 17:
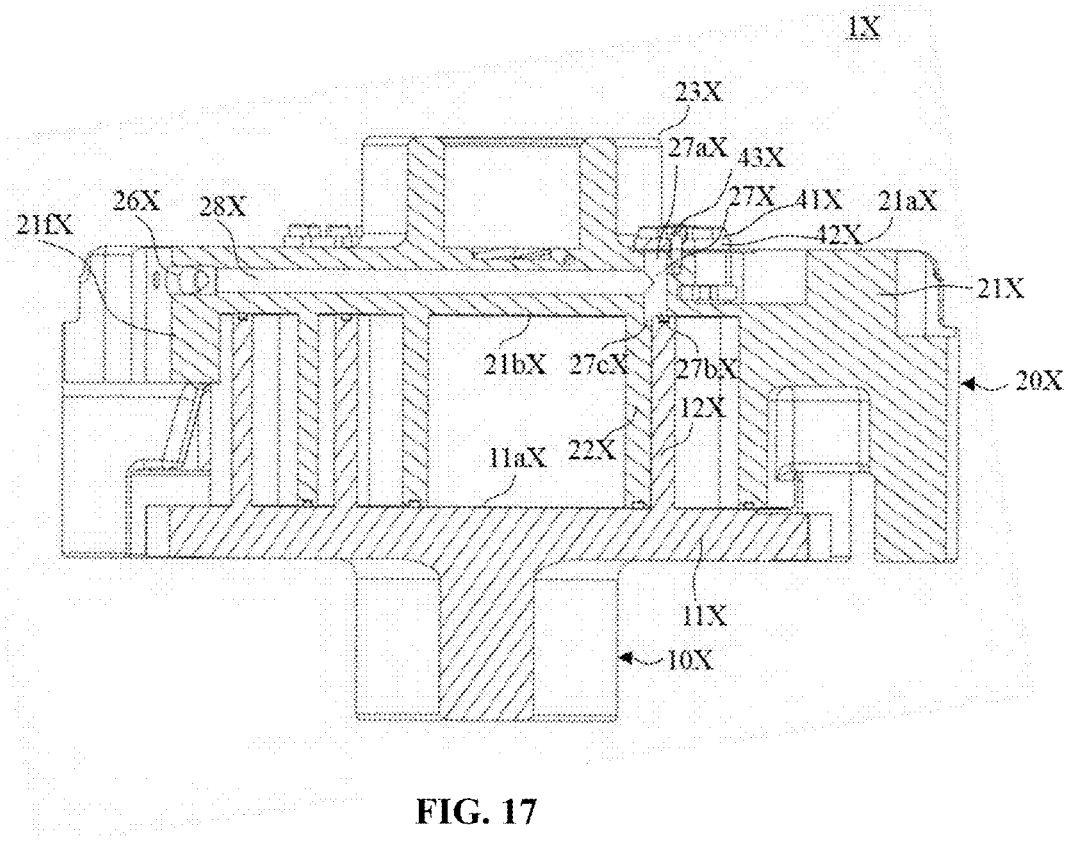
FIG. 17 illustrates a cross-sectional view of the compression mechanism in FIG. 11 taken along line BX-BX in FIG. 16.

FIG. 16 illustrates a cross-sectional view of the compression mechanism 1X of the scroll compressor taken along line AX-AX in FIG. 13, and FIG. 17 illustrates a cross-sectional view of the compression mechanism 1X of the scroll compressor taken along line BX-BX in FIG. 16. As shown in FIGS. 13 to 17, the fixed scroll component 20X may further include an enhanced vapor injection inlet orifice 26X formed at an outer peripheral surface 21*f*X of the end plate 21X, an enhanced vapor injection jet orifice 27X extending downwardly from an upper surface 21*a*X of the end plate 21X through the end plate 21X into the compression chamber, and an enhanced vapor injection passage extending inside the end plate 21X through which the enhanced vapor injection inlet orifice 26X is in communication with the enhanced vapor injection jet orifice 27X. In this embodiment, the fixed scroll component 20X includes two enhanced vapor injection jet orifices 27X, each of the enhanced vapor injection jet orifices 27X is located near a group of bypass orifices 24X. In other embodiments, any number of enhanced vapor injection jet orifices may be provided. As shown in FIG. 17, during operation of the scroll compressor, openings 27*a*X, located at the upper surface 21*a*X of the end plate 21X, of the enhanced vapor injection jet orifices 27X are sealed, and openings 27*b*X, located at the lower surface 21*b*X of the end plate 21X, of the enhanced vapor injection jet orifices 27X are in fluid communication with the compression chamber. As a result, a certain amount of refrigerant can be replenished to a specified location (i.e., a specified compression chamber) via the enhanced vapor injection inlet orifice 26X, the enhanced vapor injection passage 28X, and the enhanced vapor injection jet orifices 27X, thereby realizing an enthalpy enhancing effect and optimizing the performance of the scroll compressor.

Preferably, as shown in FIG. 17, at least a part of the enhanced vapor injection jet orifice 27X extends from the upper surface 21*a*X of the end plate 21X over the lower surface 21*b*X and into the fixed scroll 22X, such that the enhanced vapor injection jet orifice 27X includes a recess 27*c*X formed by removing a part of the material from the fixed scroll 22X. In the conventional technology, an enhanced vapor injection jet orifice is typically drilled from the lower surface 21*b*X of the end plate 21X, which requires that the enhanced vapor injection jet orifice avoids the fixed scroll 22 and is not allowed to extend beyond the width of the profile of the orbiting scroll 12X, so as to prevent leakage of fluid in a compression chamber that is in fluid communication with the enhanced vapor injection jet orifice to another adjacent compression chamber. As a result, the orifice diameter and flow area of the enhanced vapor injection jet orifice in the conventional technology are limited. In contrast, according to the embodiment of the present application, the enhanced vapor injection jet orifice 27X is drilled from the upper surface 21*a*X of the end plate 21X, and a part of the thickness of the fixed scroll 22X can be utilized for arranging the enhanced vapor injection jet orifice 27X, which can significantly increase the orifice diameter and the flow area of the enhanced vapor injection jet orifice 27X.

In the present application, the bypass orifices 24X for realizing the variable displacement function of the compressor and the enhanced vapor injection jet orifices 27X for realizing the enhanced vapor injection function are arranged adjacent to each other and in groups, so that the orifices can be properly sealed by a common scaling structure. As shown in FIGS. 11 and 12, the fixed scroll assembly of the scroll compressor may include a sealing assembly 40X. The sealing assembly 40X may include a press plate 41X and a sealing gasket 42X for covering and scaling the bypass orifices 24X and the enhanced vapor injection jet orifices 27X. The scaling gasket 42X is located between the press plate 41X and the bypass orifices 24X and the enhanced vapor injection jet orifices 27X. The sealing assembly 40X may further include multiple bolts 43X, which pass through corresponding bolt orifices formed in the sealing gasket 42X, the press plate 41X, and the upper surface 21*a*X of the end plate 21X to fasten and tightly press the sealing gasket 42X and the press plate 41X to the upper surface 21*a*X of the end plate 21X. In addition to the bolts 43X, any other suitable fasteners may be used. In this embodiment, two press plates 41X and two scaling gaskets 42X are provided in correspondence to two groups of bypass orifices 24X and enhanced vapor injection jet orifices 27X spaced apart from each other. The sealing assembly 40X may further include a piston 44X. The piston 44X is arranged in the bypass orifices 24X and is movable in a vertical direction so as to selectively enable the compression chamber to be in fluid communication with the low-pressure region or disconnect the compression chamber from the low-pressure region.

The sealing assembly 40X is used to seal grouped orifices, including bypass orifices and enhanced vapor injection jet orifices adjacent to each other. That is, a single sealing assembly can be used to seal a group of orifices, more than one group of orifices, or all groups of orifices. The number of sealing assemblies can thus be significantly reduced, the scaling structure can be simplified and compacted, and the time consuming in the assembly can be reduced.

As shown in FIGS. 11 and 12, the fixed scroll assembly of the scroll compressor may further include a fluid control device 50X, configured to introduce a fluid having a predetermined pressure to the upper surface of the piston 44X, control the movement of the piston 44X by controlling the pressure difference between positions above and below the piston 44X, and thereby control the switching of the scroll compressor between a fully-loaded operating state and a partially-loaded operating state. In this embodiment, the fluid control device 50X includes a solenoid valve. In other embodiments, the fluid control device 50X may include any other suitable valve and/or other mechanism.

Figure 18:
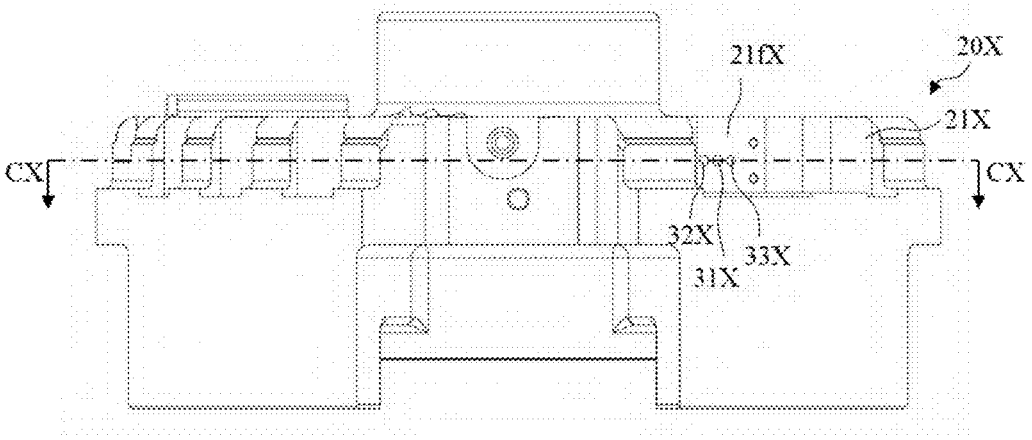
FIG. 18 illustrates a rear view of the fixed scroll component in FIG. 11.
Figure 19:
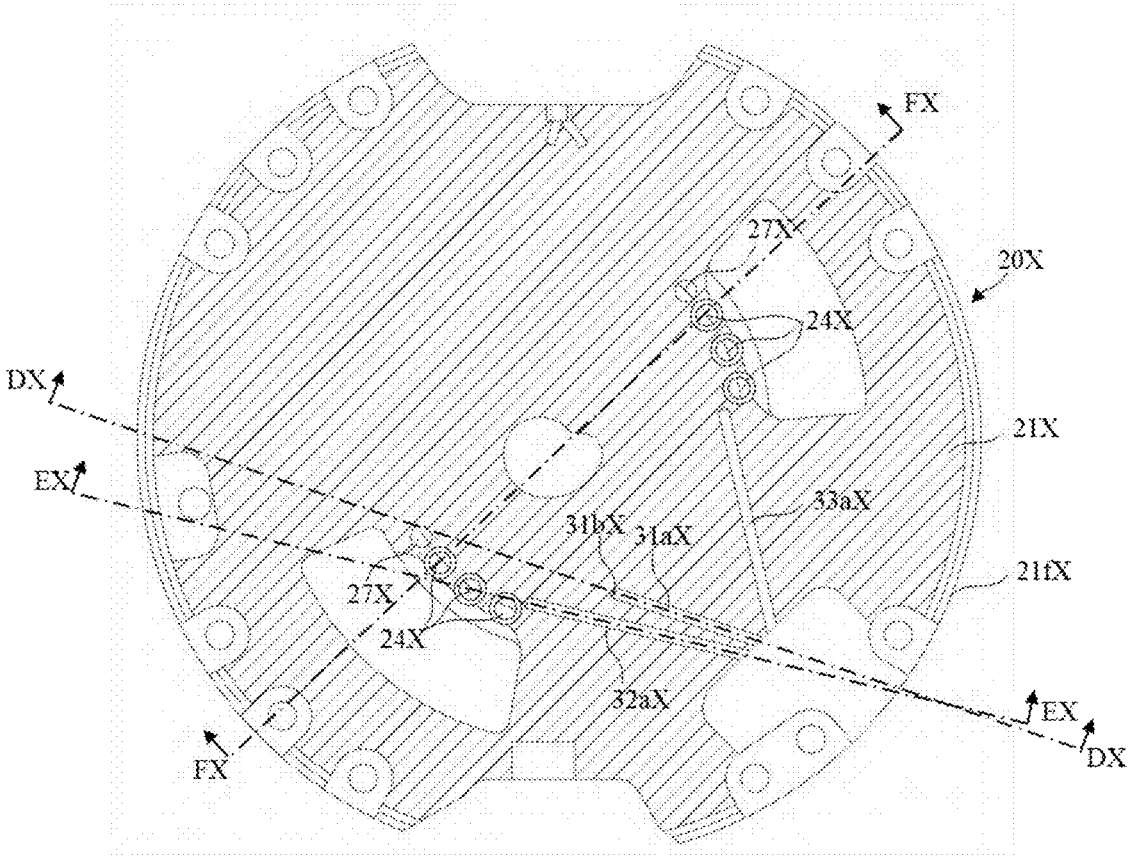
FIG. 19 illustrates a cross-sectional view of the fixed scroll component in FIG. 11 taken along line CX-CX in FIG. 18.
Figure 20:
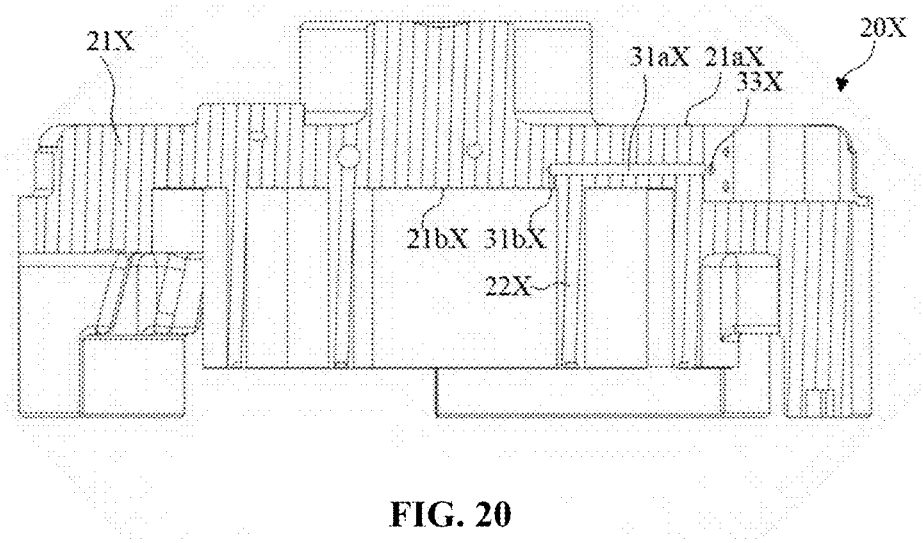
FIG. 20 illustrates a cross-sectional view of the fixed scroll component in FIG. 11 taken along line DX-DX in FIG. 19.
Figure 21:
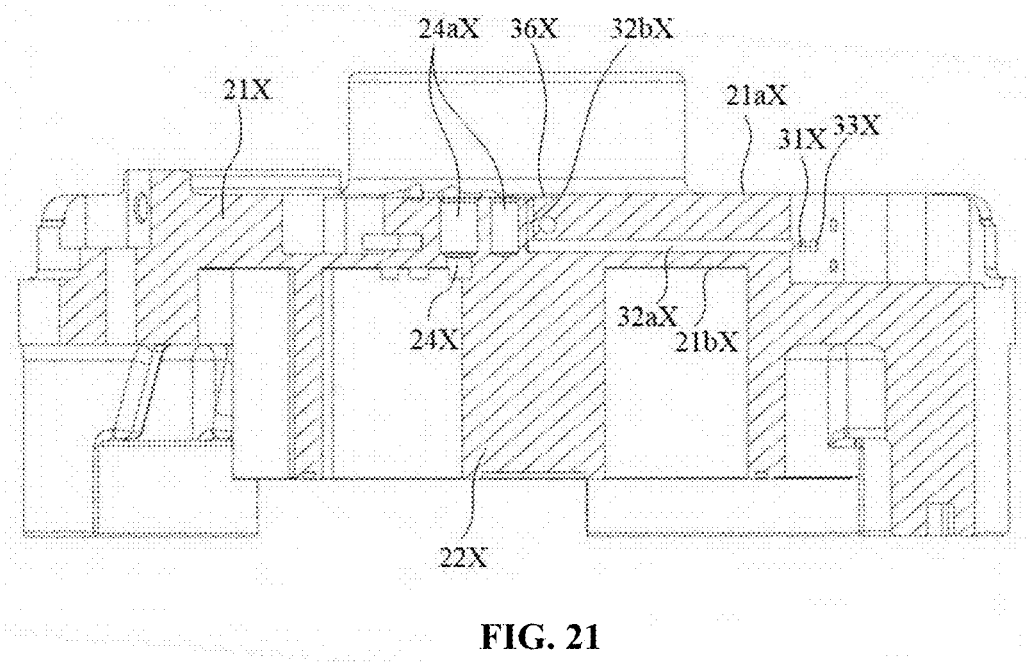
FIG. 21 illustrates a cross-sectional view of the fixed scroll component in FIG. 11 taken along the line EX-EX in FIG. 19.
Figure 22:
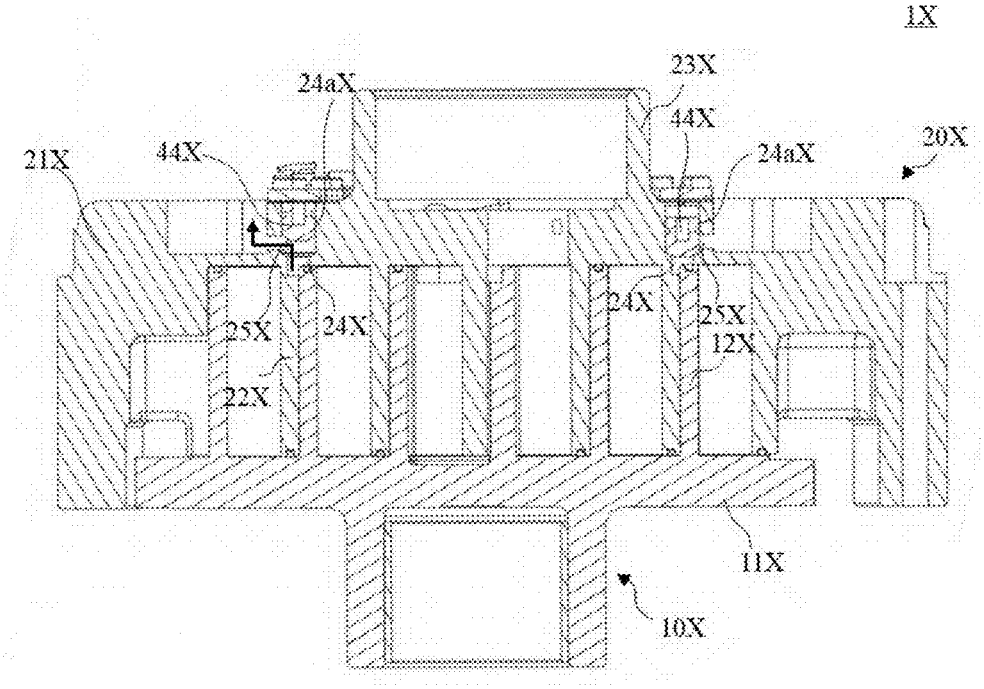
FIG. 22 illustrates a cross-sectional view of the compression mechanism in FIG. 11 taken along line FX-FX in FIG. 19.

The process and principles of operation of the sealing assembly 40X and the fluid control device 50X are described below in conjunction with FIGS. 18 to 22. FIG. 18 illustrates a rear view of the fixed scroll component 20X; FIG. 19 illustrates a cross-sectional view of the fixed scroll component 20X taken along line CX-CX in FIG. 18; FIG. 20 illustrates a cross-sectional view of the fixed scroll component 20X taken along line DX-DX in FIG. 19; FIG. 21 illustrates a cross-sectional view of the fixed scroll component 20X taken along line EX-EX in FIG. 19; and FIG. 22 illustrates a cross-sectional view of a compression mechanism 1X of a scroll compressor taken along line FX-FX in FIG. 19.

As shown in FIGS. 18 and 19, the end plate 21X of the fixed scroll component 20X is provided with a first fluid passage 31X, a second fluid passage 32X, and a third fluid passage 33X extending from an outer peripheral surface 21*f*X of the end plate 21X to an interior of the end plate 21X. As shown in FIGS. 19 and 20, the first fluid passage 31X may include a transverse extension section 31*a*X and a pressure tapping orifice 31*b*X which extends to a lower surface 21*b*X of the end plate 21X at an inner end of the transverse extension section 31*a*X. The pressure tapping orifice 31*b*X of the first fluid passage 31X is in fluid communication with the high-pressure region. In the helical fluid compression path of the fixed scroll component 20X, the pressure tapping orifice 31*b*X may be located radially inside the bypass orifice 24X, that is, the pressure tapping orifice 31*b*X is closer to the center of the fixed scroll component 20X than each of the bypass orifices 24X. As shown in FIG. 19, the second fluid passage 32X and the third fluid passage 33X each corresponds to a group of bypass orifices 24X. Referring to FIGS. 14 and 21, the second fluid passage 32X may include a transverse extension section 32*a*X and a communication orifice 32*b*X extending to an upper surface 21*a*X of the end plate 21X at an inner end of the transverse extension section 32*a*X. A communication groove 36X enabling the group of bypass orifices 24X to be in communication with each other and with the communication orifice 32_b_X is provided on the upper surface 21_a_X of the end plate 21X. Similarly, as shown in FIGS. 14 and 19, the third fluid passage 33X may include a transverse extension section 33_a_X and a communication orifice 33_b_X extending to the upper surface 21_a_X of the end plate 21X at an inner end of the transverse extension section 33_a_X. A communication groove 38X enabling the group of bypass orifices 24X to be in communication with each other and with the communication orifice 33_b_X is provided on the upper surface 21_a_X of the end plate 21X. As shown in FIG. 21, the orifice diameter of the upper portion of each bypass orifice 24X is slightly greater than the orifice diameter of the lower portion, and the upper portion of the bypass orifice 24X defines a piston chamber 24_a_X for accommodating the piston 44X. The piston 44X is movable in a vertical direction within the piston chamber 24_a_X and is capable blocking the lower portion of the bypass orifice 24X. In the assembled state, the communication orifices 32_b_X, 33_b_X and the communication grooves 36X, 38X are covered and sealed by the press plate 41X and the sealing gasket 42X, and fluids from the second fluid passage 32X and the third fluid passage 33X are capable of flowing, through the communication grooves 36X, 38X, respectively, into the corresponding piston chamber 24_a_X and acting on the upper surface of the piston 44X.

As shown in FIGS. 11 and 12, a fluid control device 50X is arranged on an outer peripheral surface 21_f_X of the end plate 21X of the fixed scroll component 20X and is located between the first fluid passage 31X, the second fluid passage 32X, and the third fluid passage 33X. In this embodiment, a recess 21_g_X for receiving the fluid control device 50X is formed on the outer peripheral surface 21_f_X of the end plate 21X. The fluid control device 50X is configured to selectively enable the first fluid passage 31X to be in fluid communication with the second fluid passage 32X and the third fluid passage 33X or disconnect the first fluid passage 31X from the second fluid passage 32X and the third fluid passage 33X, so as to change the pressure difference between positions above and below the piston 44X and to control the movement of the piston 44X in a vertical direction by the pressure difference. The piston 44X is movable between a first position where the corresponding compression chamber is allowed to be in fluid communication with the low-pressure region external to the fixed scroll component 20X and a second position where the corresponding compression chamber is prevented from being in fluid communication with the low-pressure region. FIG. 22 schematically and simultaneously shows the first position of the piston 44X (see a left piston 44X in FIG. 22) and the second position of the piston 44X (see a right piston 44X in FIG. 22).

In an embodiment where the fluid control device 50X is a solenoid valve, when the solenoid valve is de-energized, the solenoid valve is configured to enable the first fluid passage 31X to be in fluid communication with the second fluid passage 32X and the third fluid passage 33X, and the high-pressure fluid from the high-pressure region corresponding to the pressure tapping orifice 31_b_X flows into a piston chamber 24_a_X in each of the corresponding group of bypass orifices 24X through the first fluid passage 31X, the second fluid passage 32X, and the communication groove 36X. In addition, the high-pressure fluid from the high-pressure region corresponding to the pressure tapping orifice 31_b_X flows into a piston cavity 24_a_X in each of the corresponding another group of bypass orifices 24X through the first fluid passage 31X, the third fluid passage 33X, and the communication groove 38X. Therefore, the pressure at the position above each piston 44X corresponds to the pressure of the fluid at the pressure tapping orifice 31_b_X, and the pressure below each piston 44X corresponds to the pressure of the fluid in the compression chamber in fluid communication with the corresponding bypass orifice 24X. Since the pressure tapping orifice 31_b_X is closer to the center of the fixed scroll component 20X than each of the bypass orifices 24X on the helical fluid compression path, the pressure of the fluid at the high-pressure region corresponding to the pressure tapping orifices 31_b_X is greater than the pressure of the fluid in the compression chamber in fluid communication with each of the bypass orifices 24X. That is, the pressure at the position above the piston 44X is greater than the pressure at the position below the piston 44X. As a result, the piston 44X is compressed by the high-pressure fluid above the piston 44X and descends to its second position, thereby blocking the bypass orifices 24X and the exhaust slot 25X, as shown in the right half of FIG. 22.

When the solenoid valve is energized, the solenoid valve is configured to disconnect the first fluid passage 31X from the second fluid passage 32X and the third fluid passage 33X. In this case, the high-pressure fluid located above the piston 44X in the piston chamber 24_a_X of each of bypass orifices 24X is discharged via the fluid path in the solenoid valve, causing the pressure at the position below the piston 44X to be greater than the pressure at the position above the piston 44X. As a result, the piston 44X is moved upwardly to its first position so that the bypass orifice 24X is in fluid communication with the exhaust slot 25X, and the fluid in the corresponding compression chamber is capable of flowing out through the bypass orifice 24X and the exhaust slot 25X, as shown by the arrow in the left half of FIG. 22.

FIGS. 23 to 27 illustrate a compression mechanism 1X' of a scroll compressor according to another embodiment of the present application. The differences between the compression mechanism 1X' and the compression mechanism 1X described above will be mainly described hereinafter, in which the same or corresponding features or components are indicated by the same reference numerals with an apostrophe.

Figure 23:
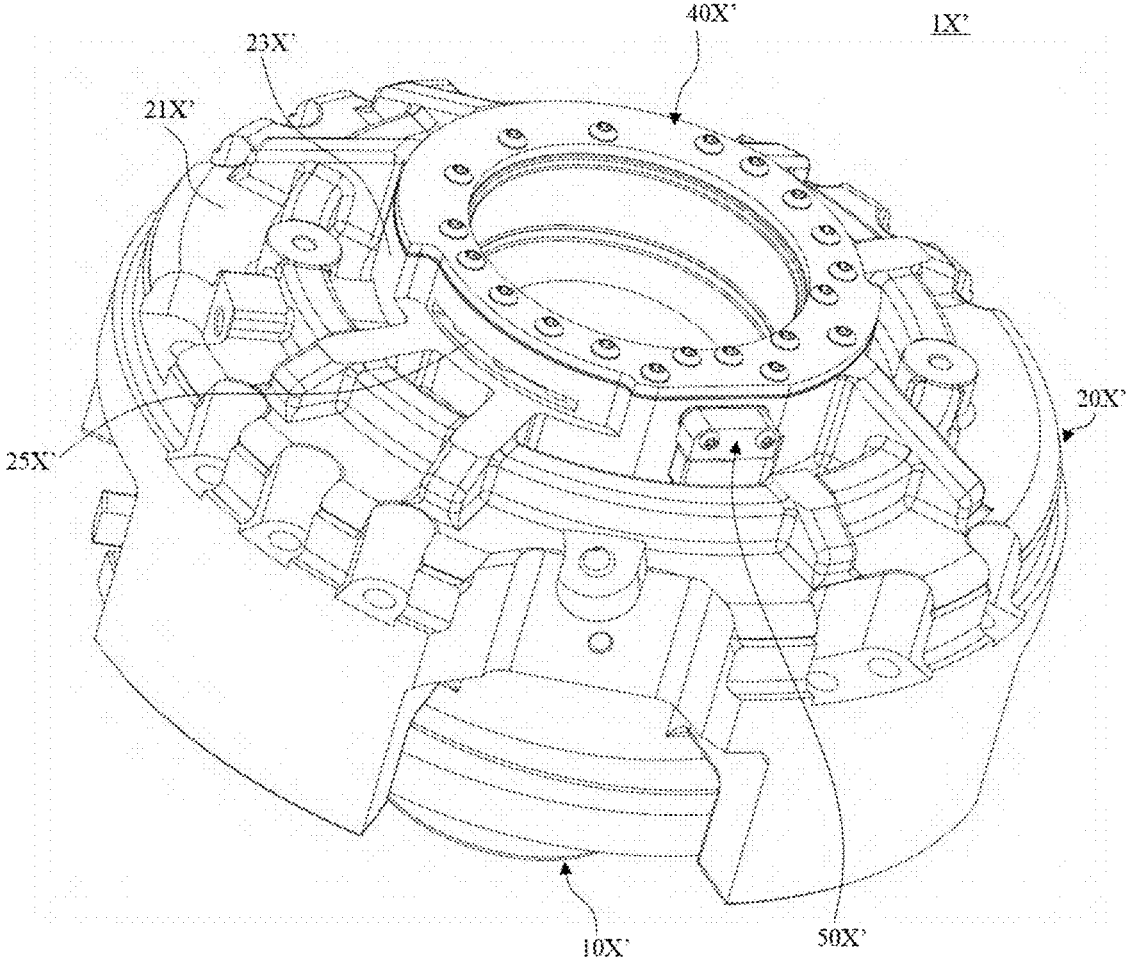
FIG. 23 illustrates a three-dimensional view of a compression mechanism of a scroll compressor according to still yet another embodiment of the present application.
Figure 24:
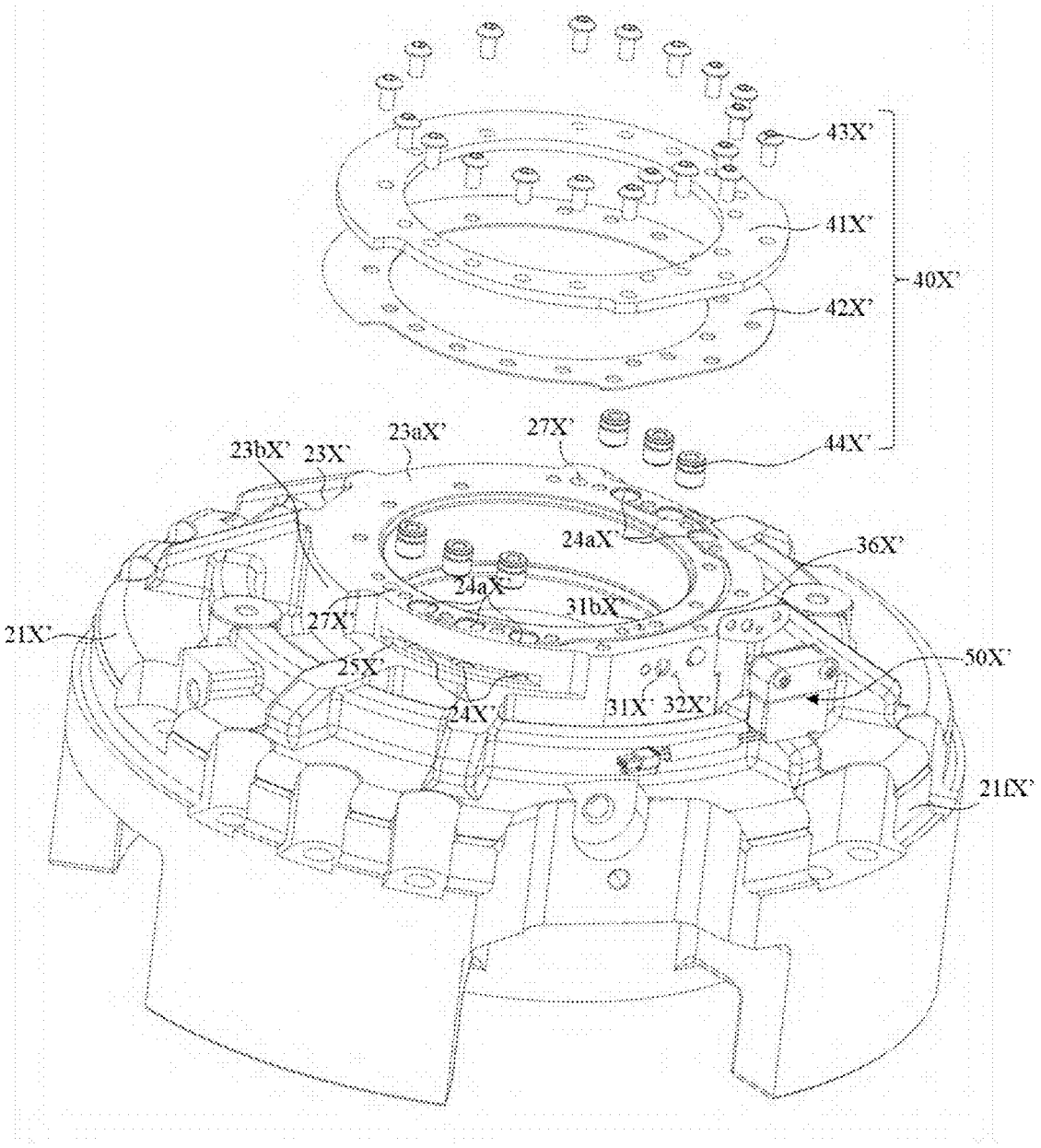
FIG. 24 illustrates an exploded view of a fixed scroll assembly in FIG. 23.

FIG. 23 illustrates a three-dimensional view of a compression mechanism 1X' of a scroll compressor. The compression mechanism 1X' includes an orbiting scroll component 10X' and a fixed scroll component 20X' that mate with each other to form a compression chamber. FIG. 24 illustrates an exploded view of a fixed scroll assembly in FIG. 23. The fixed scroll assembly may include a fixed scroll component 20X', a sealing assembly 40X' connected to the fixed scroll component 20X', and a fluid control device 50X'. As shown in FIG. 24, in this embodiment, the fixed scroll component 20X' includes two groups of bypass orifices 24X' spaced apart from each other and enhanced vapor injection jet orifices 27X' arranged adjacent to each group of bypass orifices 24X'. Each of the bypass orifices 24X' and the enhanced vapor injection jet orifices 27X' extends downwardly from an upper surface 23_a_X' of a hub portion 23X' of the fixed scroll component 20X' through the hub portion 23X' and the end plate 21X 'until the bypass orifice 24X' and the enhanced vapor injection jet orifice 27X' are in fluid communication with the compression chamber. Two exhaust slots 25X' are provided at an outer peripheral surface 23_b_X' of the hub portion 23X', each of the exhaust slots 25X' extends into each of the corresponding group of bypass orifices 24X' such that each of the bypass orifices in the group of bypass orifices 24X' is capable of being in communication with each other via the exhaust slots 25X' and with a low-pressure region external to the fixed scroll component 20X'. In other embodiments, an exhaust slot which enables all of the bypass orifices 24X' to be in communication with each other and with the exterior of the fixed scroll component 20X' may be provided. A communication groove 36X' allowing all the bypass orifices 24X' to be in communication with each other is further provided on the upper surface 23*a*X' of the hub portion 23X'. The sealing assembly 40X' includes a substantially ring-shaped press plate 41X' and a sealing gasket 42X', the press plate 41X' and the sealing gasket 42X' cover the upper surface 23*a*X' of the hub portion 23X', and cover and seal all bypass orifices 24X' and enhanced vapor injection jet orifices 27X'. The sealing assembly 40X' may further include: multiple bolts 43X' or other fastening structures configured to fasten and tightly press the press plate 41X' and the sealing gasket 42X' to the upper surface 23*a*X of the hub portion 23X'; and a piston 44X' which is movable in a vertical direction in a piston chamber 24*a*X' of each bypass orifice 24X'.

Similar to the fixed scroll component 20X in the previous embodiment, in the present embodiment, an enhanced vapor injection inlet orifice (not shown) is likewise formed at an outer peripheral surface 21*f*X' of the end plate 21X' of the fixed scroll component 20X', and an enhanced vapor injection passage (not shown) through which the enhanced vapor injection inlet orifice and the enhanced vapor injection jet orifice 27X' are connected is likewise formed inside the end plate 21X' of the fixed scroll component 20X'. However, it should be understood that the present application is not limited thereto, and the enhanced vapor injection inlet orifice and the enhanced vapor injection passage may be formed in other positions of the fixed scroll component, for example, may be formed in the hub portion.

As shown in FIGS. 23 and 24, in this embodiment, the fluid control device 50X' is arranged on an outer peripheral surface 23*b*X' of the hub portion 23X' of the fixed scroll component 20X'. As a result, the fluid flow path for controlling the movement of the piston 44X' in a vertical direction can be further simplified, which will be further described below in conjunction with FIGS. 25 to 27.

Figure 25:
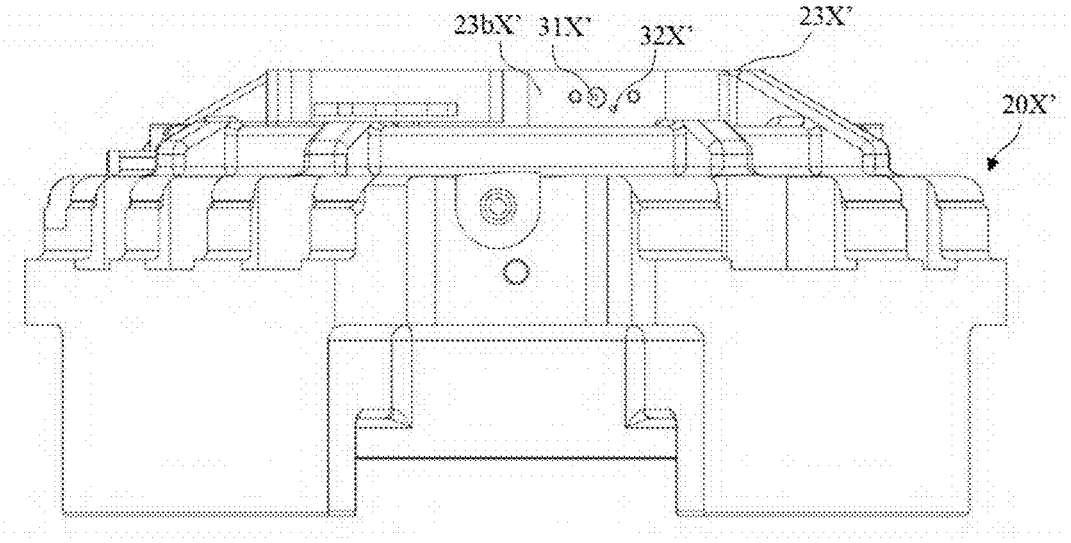
FIG. 25 illustrates a side view of a fixed scroll component in FIG. 23.
Figure 26:
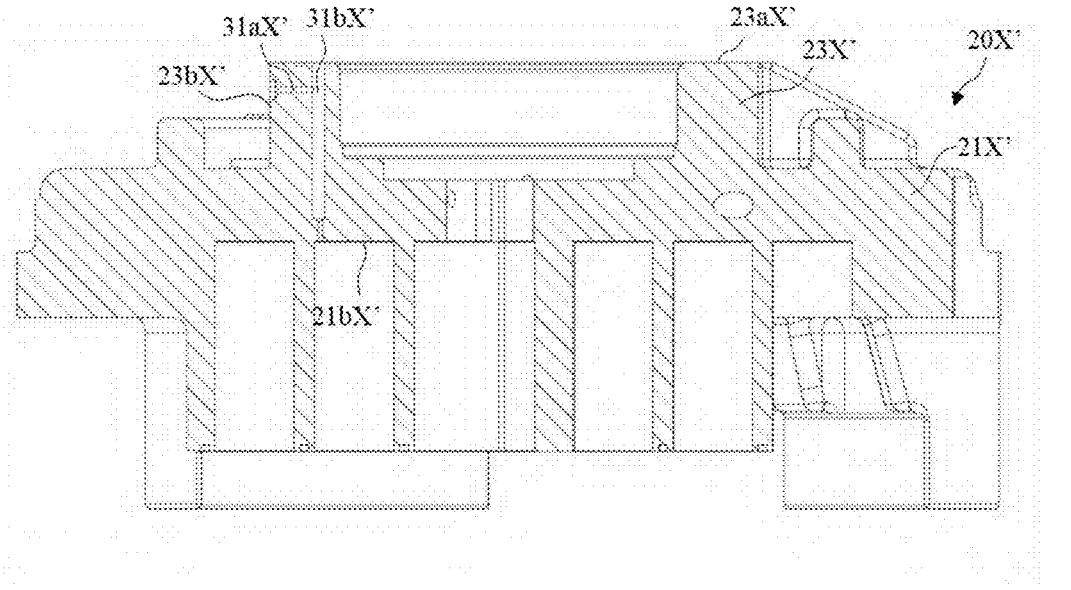
FIG. 26 illustrates a cross-sectional view of the fixed scroll component taken along a vertical plane passing through an axis of a first fluid passage as shown in FIG. 25.
Figure 27:
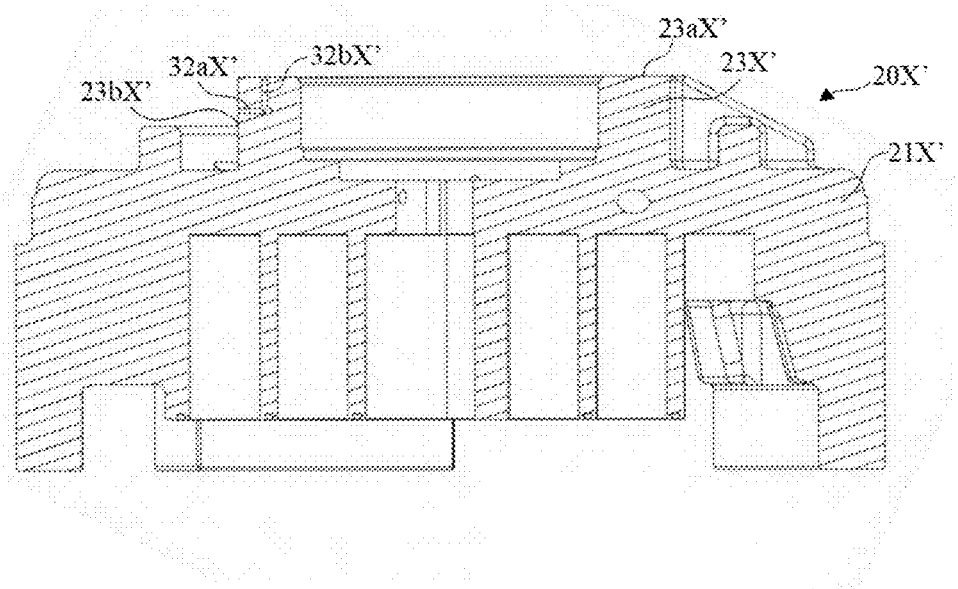
FIG. 27 illustrates a cross-sectional view of the fixed scroll component taken along a vertical plane passing through an axis of a second fluid passage as shown in FIG. 25.

FIG. 25 illustrates a side view of the fixed scroll component 20X' showing a first fluid passage 31X' and a second fluid passage 32X' formed in a hub portion 23X' of the fixed scroll component 20X'. FIG. 26 illustrates a cross-sectional view of the fixed scroll component 20X' taken along a vertical plane passing through an axis of the first fluid passage 31X'; FIG. 27 illustrates a cross-sectional view of the fixed scroll component 20X' taken along a vertical plane passing through an axis of the second fluid passage 32X'. As shown in FIGS. 24 to 26, the first fluid passage 31X' of the fixed scroll component 20X' extends from an outer peripheral surface 23*b*X' of the hub portion 23X' to an interior of the hub portion 23X'. The first fluid passage 31X' includes a transverse extension section 31*a*X' and a pressure tapping orifice 31*b*X', the pressure tapping orifice 31*b*X' is provided at an inner end of the transverse extension section 31*a*X' and extends from an upper surface 23*a*X' of the hub portion 23X' downwardly through the hub portion 23X' and the end plate 21X' to the lower surface 21*b*X' of the end plate 21X', whereby the pressure tapping orifice 31*b*X' is in fluid communication with a predetermined high-pressure region in the compression chamber. In the helical fluid compression path of the fixed scroll component 20X', the pressure tapping orifice 31*b*X' may be positioned radially inside the bypass orifice 24X', that is, the pressure tapping orifice 31*b*X' is closer to the center of the fixed scroll component 20X' than each of the bypass orifices 24X'. In the assembled state, the pressure tapping orifice 31*b*X' is sealed at the upper surface 23*a*X' of the hub portion 23X' by the press plate 41X' and the sealing gasket 42X'. As shown in FIGS. 24, 25, and 27, a second fluid passage 32X' in the fixed scroll component 20X' extends from the outer peripheral surface 23*b*X' of the hub portion 23X' to the interior of the hub portion 23X'. The second fluid passage 32X' includes a transverse extension section 32*a*X' and a communication orifice 32*b*X', the communication orifice 32*b*X' extends upwardly from an inner end of the transverse extension section 32*a*X' to the communication groove 36X' on the upper surface 23*a*X' of the hub portion 23X'. In the assembled state, the communication orifice 32*b*X' and the communication groove 36X' are sealed by the press plate 41X' and the sealing gasket 42X'.

Similar to the fluid control device 50X according to the previous embodiment, the fluid control device 50X' is located between the first fluid passage 31X' and the second fluid passage 32X' and is configured to selectively enable the first fluid passage 31X' to be in fluid communication with the second fluid passage 32X' or disconnect the first fluid passage 31X' from the second fluid passage 32X', to change the pressure difference at positions above and below the piston 44X' and thereby control the piston 44X' to move in a vertical direction by the pressure difference. In an embodiment where the fluid control device 50X' is a solenoid valve, when the solenoid valve is de-energized, the solenoid valve is configured to enable the first fluid passage 31X' to be in fluid communication with the second fluid passage 32X', and the high-pressure fluid from the high-pressure region corresponding to the pressure tapping orifice 31*b*X' flows into a piston chamber 24*a*X' in each of the bypass orifices 24X' through the first fluid passage 31X', the second fluid passage 32X', and the communication groove 36X'. Therefore, the pressure at a position above the piston 44X' is greater than the pressure at a position below the piston 44X', and the piston 44X' is compressed by the high-pressure fluid above the piston 44X' and descends to the second position, thereby blocking the bypass orifices 24X' and the exhaust slot 25X', so that the scroll compressor is in a fully-loaded operating state. When the solenoid valve is energized, the solenoid valve is configured to disconnect the first fluid passage 31X' from the second fluid passage 32X'. At this time, the high-pressure fluid, located above the piston 44X', in the piston chamber 24*a*X' of each bypass orifice 24X' is discharged through the fluid path in the solenoid valve, such that the pressure at the position below the piston 44X' is greater than the pressure at the position above the piston 44X'. Accordingly, the piston 44X' is moved upwardly to the first position so that the bypass orifices 24X' are in fluid communication with the exhaust slot 25X', and the fluid in the corresponding compression chamber flows out through the bypass orifices 24X' and the exhaust slot 25X'.

A method for machining a fixed scroll assembly is provided according to yet another aspect of the present application. The fixed scroll assembly may include a fixed scroll component having a fixed scroll and an end plate. The method may include: machining at least one group of orifices in the fixed scroll component, each group of orifices in the at least one group of orifices includes a bypass orifice and an enhanced vapor injection jet orifice; and manufacturing a scaling assembly for sealing each or all of the orifices in the at least one group of orifices. Specifically, the step of machining the at least one group of orifices may include machining the bypass orifice and the enhanced vapor injection jet orifice from an upper surface of the end plate towards a corresponding compression chamber. The step of machining the at least one group of orifices may also include machining the bypass orifice and the enhanced vapor injection jet orifice from an upper surface of the hub portion towards a corresponding compression chamber. Preferably, a part of the material may be removed from the fixed scroll of the fixed scroll component in the machining of the enhanced vapor injection jet orifice. In addition, the method may further include the step of machining, at an upper surface of the fixed scroll component, a communication groove enabling each group of bypass orifices or all of the bypass orifices to be in communication with each other and with a high-pressure region. In an embodiment, the communication groove may be machined on an upper surface of an end plate of the fixed scroll component or on an upper surface of the hub portion. In addition, the method may further include the step of machining, in the fixed scroll component, an exhaust slot enabling each group of bypass orifices or all of the bypass orifices to be in communication with each other and with a low-pressure region external to the fixed scroll component. The exhaust slot may be machined in a recess in the upper surface of the end plate or on the outer peripheral surface of the hub portion. The above steps are not necessarily performed in the order described herein.

In some embodiments of the present application, the bypass orifice and the enhanced vapor injection jet orifice are arranged adjacent to each other on the upper surface of the fixed scroll component, and can be sealed simultaneously by means of a common sealing assembly. As a result, the structure and machining process of the scroll compressor can be simplified, and the need for sealing components can be reduced, making the sealing structure integrated and compact, and the time consuming in the machining can be reduced accordingly. In addition, by providing a communication groove on the upper surface of the fixed scroll component configured to enable two or more bypass orifices to be in communication with each other and with the high-pressure region, high-pressure fluid can be introduced into the corresponding multiple or all of the bypass orifices at the same time, thereby simultaneously control the communication or disconnecting of the multiple or all of the bypass orifices with or from the low-pressure region by a piston in the bypass orifices. The provision of the exhaust slot in which two or more of the bypass orifices are in communication with each other and with the low-pressure region external to the fixed scroll component facilitates increasing the exhaust area. The communication groove and the exhaust slot are of a simple structure simple and are easy to machine.

The features such as the enhanced vapor injection jet orifices, the bypass orifices, the sealing assembly, the communication groove and the exhaust slot provided on the fixed scroll component in the embodiments of the present application can also be applied to the orbiting scroll assembly.

Exemplary embodiments of the fixed scroll assembly, the scroll compressor, and the method for machining a fixed scroll assembly according to the present application have been described in detail herein, but it should be understood that the present application is not limited to the specific embodiments described and illustrated in detail above. Various embodiments according to the present application may be implemented individually or in combination. Without departing from the subject matter and scope of the present application, various variations and variants can be made by those skilled in the art to the present application. All the variations and variants shall fall within the scope of the present application. Moreover, all of the components described herein can be replaced by other technically equivalent components.

The invention claimed is:

1. A fixed scroll assembly, comprising:

a fixed scroll component comprising an end plate and a fixed scroll extending from a first side of the end plate, wherein the fixed scroll component is provided with an enhanced vapor injection jet orifice extending from an upper surface of the fixed scroll component to a compression chamber, wherein an enhanced vapor injection fluid external to a compressor comprising the fixed scroll assembly is capable of being supplied into the compression chamber via the enhanced vapor injection jet orifice, and the enhanced vapor injection jet orifice has a first end leading to the compression chamber and a second end leading to an exterior of the fixed scroll assembly; and a sealing assembly, configured to seal the second end of the enhanced vapor injection jet orifice, wherein the enhanced vapor injection jet orifice comprises a first part and a second part, wherein the first part extends to the first side of the end plate and is not overlapped with the fixed scroll when viewed in an axial direction of the fixed scroll assembly, and the second part extends through the end plate into the fixed scroll and is overlapped with the fixed scroll when viewed in the axial direction of the fixed scroll assembly, wherein the second part comprises a recess formed in the fixed scroll by removing a part of material from a lower surface of the end plate towards the fixed scroll.

2. The fixed scroll assembly according to claim 1, wherein the enhanced vapor injection jet orifice extends through the end plate from a second side, opposite to the first side, of the end plate; or wherein the fixed scroll component comprises a hub portion protruding in an axial direction of the fixed scroll assembly from a second side, opposite to the first side, of the end plate, and the enhanced vapor injection jet orifice extends through the hub portion and the end plate from an upper surface of the hub portion.

3. The fixed scroll assembly according to claim 1, wherein the fixed scroll component further comprises an enhanced vapor injection inlet orifice and an enhanced vapor injection passage connecting the enhanced vapor injection inlet orifice with the enhanced vapor injection jet orifice, wherein the enhanced vapor injection jet orifice has a hydraulic diameter less than or equal to a hydraulic diameter of the enhanced vapor injection passage.

4. The fixed scroll assembly according to claim 1, wherein in a thickness direction of the fixed scroll, a depth of the recess does not exceed two thirds of a thickness of the fixed scroll; and/or wherein a height of the recess along the axial direction of the fixed scroll component is greater than or equal to a hydraulic radius of the enhanced vapor injection jet orifice.

5. The fixed scroll assembly according to claim 1, wherein the fixed scroll component comprises at least one group of orifices, each group of orifices in the at least one group of orifices comprises a bypass orifice and the enhanced vapor injection jet orifice, wherein a fluid in the compression chamber is dischargeable through the bypass orifice into a low-pressure region external to the fixed scroll component, and wherein the sealing assembly is configured to seal grouped orifices in the at least one group of orifices.

6. The fixed scroll assembly according to claim 5, wherein the fixed scroll component comprises two or more groups of orifices spaced apart in a circumferential direction, wherein each group of orifices in the two or more groups of orifices comprises at least one said bypass orifice and at least one said enhanced vapor injection jet orifice.

7. The fixed scroll assembly according to claim 5, wherein the sealing assembly comprises a piston, which is provided in the bypass orifice and is movable between a first position where a corresponding compression chamber is permitted to be in fluid communication with the low-pressure region and a second position where the corresponding compression chamber is prevented from being in fluid communication with the low-pressure region.

8. The fixed scroll assembly according to claim 7, wherein the fixed scroll component further comprises a fluid passage communicating the bypass orifice with a high-pressure region, wherein a fluid in the high-pressure region has a pressure greater than a pressure of the fluid in the compression chamber in communication with the bypass orifice.

9. The fixed scroll assembly according to claim 8, further comprising a fluid control device, configured to control a pressure difference between positions above and below the piston by introducing a fluid having a predetermined pressure to the position above the piston, to control movement of the piston.

10. The fixed scroll assembly according to claim 9, wherein the fluid control device comprises a valve, configured to selectively enable the fluid passage to be in communication or to disconnect the fluid passage, to change the pressure difference between the positions above and below the piston.

11. The fixed scroll assembly according to claim 10, wherein a communication groove, which allows all of the bypass orifices or the bypass orifices in each group of orifices to be in communication with each other, is provided on the upper surface of the fixed scroll component, wherein the fluid passage comprises a first fluid passage and a second fluid passage, the first fluid passage extends from an outer peripheral surface of the fixed scroll component to the high-pressure region, the second fluid passage extends from the outer peripheral surface of the fixed scroll component to the communication groove, and the valve is arranged between the first fluid passage and the second fluid passage.

12. The fixed scroll assembly according to claim 5, wherein a communication groove, which allows all of the bypass orifices or the bypass orifices in each group of orifices to be in communication with each other and to be communicable with a high-pressure region, is provided on the upper surface of the fixed scroll component, wherein a fluid in the high-pressure region has a pressure greater than a pressure of the fluid in the compression chamber in communication with the bypass orifice, and the communication groove is sealed at the upper surface of the fixed scroll component by the sealing assembly.

13. The fixed scroll assembly according to claim 5, wherein the fixed scroll component further comprises an exhaust slot, configured to allow all of the bypass orifices or the bypass orifices in each group of orifices to be in communication with each other and in fluid communication with the low-pressure region via the exhaust slot.

14. The fixed scroll assembly according to claim 13, wherein a recess is provided on a second side, opposite to the first side, of the end plate, and the exhaust slot is provided on a side wall of the recess; or wherein the fixed scroll component comprises a hub portion protruding in an axial direction from a second side, opposite to the first side, of the end plate, and the exhaust slot is provided on an outer peripheral surface of the hub portion.

15. The fixed scroll assembly according to claim 5, wherein the bypass orifice and the enhanced vapor injection jet orifice extend from a second side, opposite to the first side, of the end plate to a corresponding compression chamber; or wherein the fixed scroll component comprises a hub portion protruding in an axial direction from a second side, opposite to the first side, of the end plate, and the bypass orifice and the enhanced vapor injection jet orifice extend from an upper surface of the hub portion into a corresponding compression chamber.

16. The fixed scroll assembly according to claim 1, wherein the sealing assembly comprises a press plate and a sealing gasket; and wherein the sealing assembly further comprises a fastener configured to fasten and tightly press the sealing gasket and the press plate to the upper surface of the fixed scroll component.

17. A scroll compressor, comprising the fixed scroll assembly according to claim 1.

18. A method for machining a fixed scroll assembly, the fixed scroll assembly being the fixed scroll assembly according to claim 1, wherein the method comprises:

machining, in a fixed scroll component, at least one enhanced vapor injection jet orifice extending from an upper surface of the fixed scroll component to a compression chamber, wherein an enhanced vapor injection fluid external to a compressor comprising the fixed scroll assembly is capable of being supplied into the compression chamber via the enhanced vapor injection jet orifice, and the enhanced vapor injection jet orifice has a first end leading to the compression chamber and a second end leading to an exterior of the fixed scroll assembly; and manufacturing a sealing assembly, configured to seal the second end of the enhanced vapor injection jet orifice.

* * * * *